US007770965B2

(12) United States Patent
Zwezdaryk

(10) Patent No.: US 7,770,965 B2
(45) Date of Patent: Aug. 10, 2010

(54) CHAIR

(76) Inventor: Shane Zwezdaryk, 111 Disco Road, P.O. Box 4950, Toronto, Ontario (CA) M9W 5L6

( * ) Notice: Subject to any disclaimer, the term of this patent is extended or adjusted under 35 U.S.C. 154(b) by 1545 days.

(21) Appl. No.: 10/409,064

(22) Filed: Apr. 9, 2003

(65) Prior Publication Data

US 2004/0212240 A1 Oct. 28, 2004

(51) Int. Cl.
*A47C 13/00* (2006.01)

(52) U.S. Cl. ..... 297/118; 297/119; 297/217.1; 128/845

(58) Field of Classification Search ..... 297/217.1, 297/217.3, 119, 118; 128/845
See application file for complete search history.

(56) References Cited

U.S. PATENT DOCUMENTS

| | | | | |
|---|---|---|---|---|
| 3,322,116 | A | 5/1967 | Murphy et al. | 128/33 |
| 3,971,592 | A | 7/1976 | Farley | |
| 4,913,423 | A * | 4/1990 | Farran et al. | 297/217.1 X |
| 5,538,011 | A | 7/1996 | Craft et al. | 128/845 |
| 5,782,243 | A | 7/1998 | Bisyak | 128/845 |
| 5,875,779 | A | 3/1999 | Fuhrman et al. | 128/845 |
| 6,003,940 | A * | 12/1999 | Jackson | 297/217.3 X |
| 6,003,949 | A | 12/1999 | Rinne et al. | 297/452.21 |
| 6,030,039 | A | 2/2000 | Essler | |
| 6,338,344 | B1 | 1/2002 | Sinohui, Jr. | 128/845 |
| 6,443,917 | B1 | 9/2002 | Canto | 601/99 |
| 2002/0070590 | A1 * | 6/2002 | Carstens | 297/217.3 X |

FOREIGN PATENT DOCUMENTS

DE 3817419 A1 * 11/1989

OTHER PUBLICATIONS http://prometheus.frii.com/~inkeep/nzm.htm, New Zealand Made BDSM Furniture, NZM Designs, Nov. 2, 2002.
http://www.lifestemptations.com/content/furniture/htm, Ottoman, Furniture and Accessories Department, Nov. 2, 2002.
http://www.closetclobber.com/index.php, Closet Clobber, Welcome to ClosetClobber.com, Nov. 2, 2002.
http://www.clickandbuild.com/cnb/shop/bondagesystems, Bondage Systems—Category Products, Nov. 2, 2002.
http://www.4-bondage.com/Bondage_Swings.htm, 4-bondage.com Swings and Furniture, Nov. 2, 2002.
http://www.ultimateadultshop.com/pages/sex-toys-bondage.htm, Bondage Toys, Ultimate Adult Shop, Nov. 2, 2002.

* cited by examiner

*Primary Examiner*—Anthony D Barfield
(74) *Attorney, Agent, or Firm*—Gowling Lafleur Henderson

(57) ABSTRACT

A chair having a base with a seating surface and a back support attached to the base for supporting a person seated on the seating surface. At least one attachment point is located on the chair for attaching an accessory for use in securing a person to the chair. The chair has a concealment means moveable between a concealment position for covering at least one attachment point and an uncovered position wherein the attachment point is accessible.

1 Claim, 29 Drawing Sheets

CHAIR

FIELD OF INVENTION

This invention relates generally to adult entertainment devices. More particularly this invention relates to a chair that appears to an ordinary chair but can be converted into a multi-functional apparatus for facilitating adult activities of a sexual nature.

BACKGROUND OF THE INVENTION

Chairs designed to facilitate sexual activity have been previously disclosed (see for example Craft U.S. Pat. No. 5,538,011 and Fuhrman U.S. Pat. No. 5,875,779) but their obtrusiveness render them unfit for use as ordinary furniture. Further, given their conspicuous nature, most people would be embarrassed to have such devices in their homes or offices. Sinohui Jr. U.S. Pat. No. 6,338,344 attempted to address these concerns by constructing a sexual intimacy chair that also appears to be an ordinary chair. However, its versatility to function as an adult entertainment device is severely compromised at the expense of maintaining an ordinary appearance. For instance, in contrast to the Craft chair, the Sinohui Jr. chair cannot receive accessories such as stirrups.

In respect of sex chairs having attachable accessories, prior art does not teach a mechanism to store their accessories in a conveniently available and secured manner. For instance, prior art does not disclose sex chairs having lockable compartments. Another draw back is that these accessories may easily be misplaced.

SUMMARY OF THE INVENTION

A chair having a base with a seating surface and a back support attached to the base for supporting a person seated on the seating surface. At least one attachment point is located on the chair for attaching an accessory for use in securing a person to the chair. The chair has a concealment means moveable between a concealment position for covering at least one attachment point and an uncovered position wherein the attachment point is accessible.

The concealment means may be shaped to maintain the contour of the chair in the concealment position.

The concealment means may be a member selected from the group consisting of a pillow, a chair cover, a plug and a cushion.

The attachment point may be a member selected from the group consisting of a slot, a bore, a bar, a peg hole, a socket and an eyelet.

The accessory may be a member selected from the group consisting of a swing, a body board table, a kneeler, a shackle, a strapping means, a headrest, a cross-board, and at least one footpad;

The accessory may be a swing having a first pole and a second pole, each attachable to a respective attachment point located on the chair in a substantially vertical position and sufficiently spaced apart to accommodate a person positioned between the poles. The poles may have at least one attachment point for attaching additional accessories. A seat may be attachable to each pole to suspend a person above the base.

The swing may also have a horizontal bar attachable to the first pole and the second pole for providing greater stability to the swing when the swing is attached to the chair and engaged by a person.

The accessory may be a body board table that is collapsible.

The body board table may be partially collapsible capable of forming generally a planar configuration, a reclined configuration and a declined configuration. The body board table may consist of a body board having a slot thereon to accommodate the face of a person and a plurality of sockets for receiving a plurality of support members. The support members may be attachable to respective attachment points on the chair to suspend the body board over the base and may be telescopic such that the height of the body board table is adjustable.

The chair may have arm rests for supporting the arms of a person seated on the seating surface.

The chair may have an electrical outlet located on the chair generally away from plain view and a conducting means connected thereto for providing electricity to the electrical outlet.

The chair may have a vibrating means for providing vibration.

The vibrating means may be located within the chair away from plain view. Further, the vibrating means may be electrically powered and have a switch connected thereto and located on the chair for activating and deactivating the vibrating means.

The chair may have a plurality of rollers attached to the bottom face of the chair for assisting a person in moving the chair.

The chair may have a storing means for storing the accessories.

The storing means may have a closed configuration wherein the contour of the chair is maintained when the storing means is in the closed configuration.

The storing means may be constructed to store the accessories entirely therein as a self-contained unit.

DESCRIPTION OF DRAWINGS

Preferred embodiments of the present invention are described in detail below with reference to the accompanying illustrations in which.

DESCRIPTION OF PREFERRED EMBODIMENTS

Figure 1:
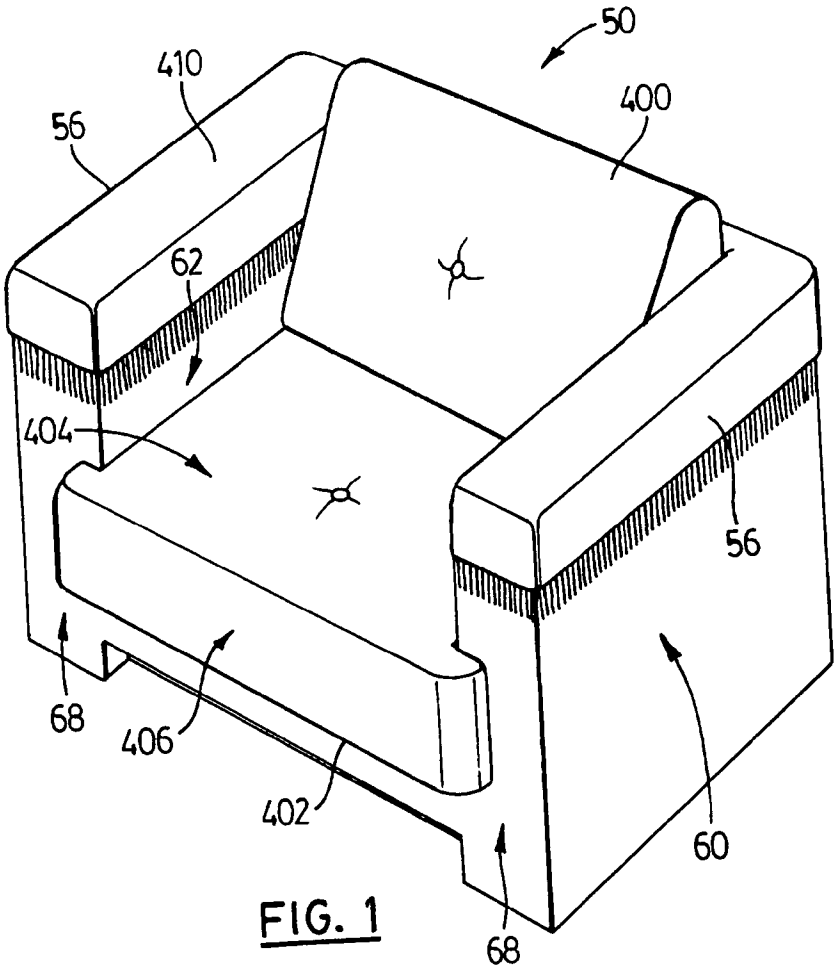
FIG. 1 is a perspective view illustrating a chair according to the present invention.

A chair according to the present invention is generally indicated by reference 50 in the accompanying illustrations. The Chair includes a base 52, a seating surface 404 and a back support 54 to accommodate a person seated on the seating surface 404.

As described in more detail below, a plurality of accessories may be attachable to the chair 50 at a plurality of attachment points. When the accessories are attached to the chair 50, the resulting structure provides different means for securing a person to the chair 50.

Figure 2:
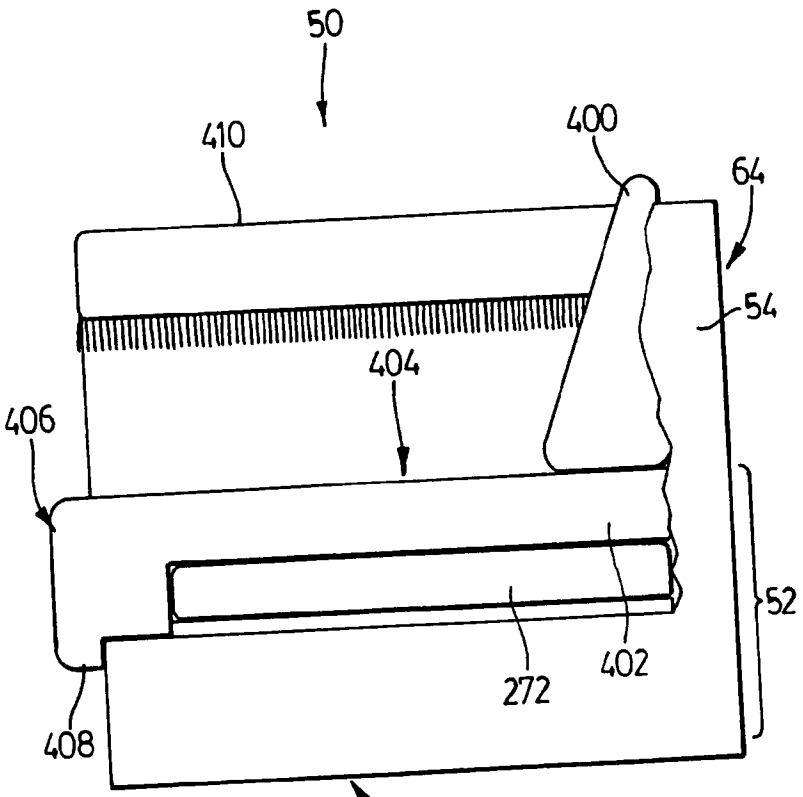
FIG. 2 is a partial sectional view of the chair of FIG. 1 illustrating a plurality of cushions and a body board stored therein according to the present invention.

A first embodiment of the Chair 50 is illustrated in FIG. 1. As illustrated in FIGS. 1, and 2, the chair 50 may have a cuboid base 52, attached thereto a back support 54 and arm rests 56, cooperating together to form supporting means for accommodating a person seated on the chair 50. In accordance with FIG. 6, the bottom portion of the base 52 may be recessed.

Figure 3:
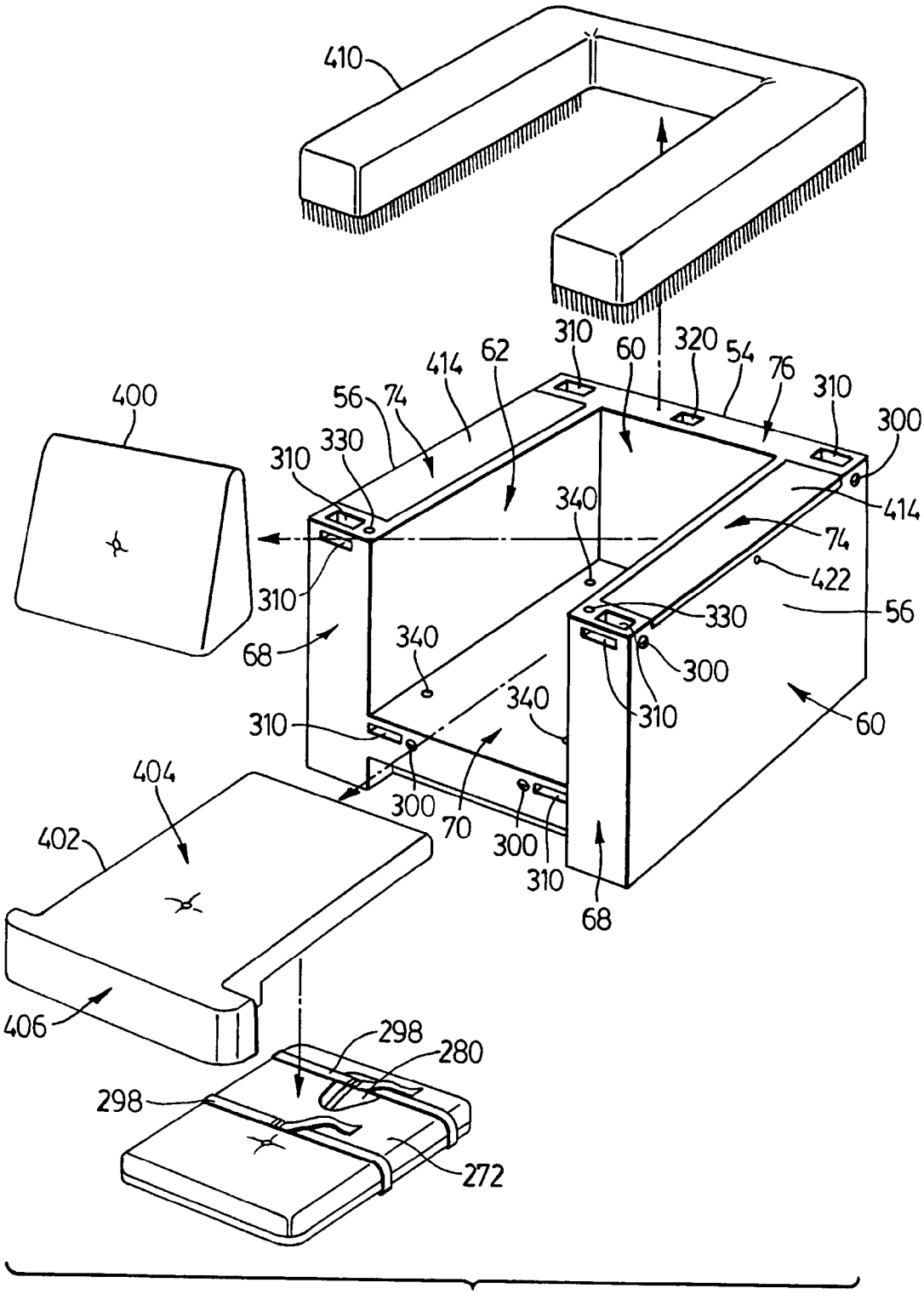
FIG. 3 is an exploded view of the chair of FIG. 1.
Figure 6:
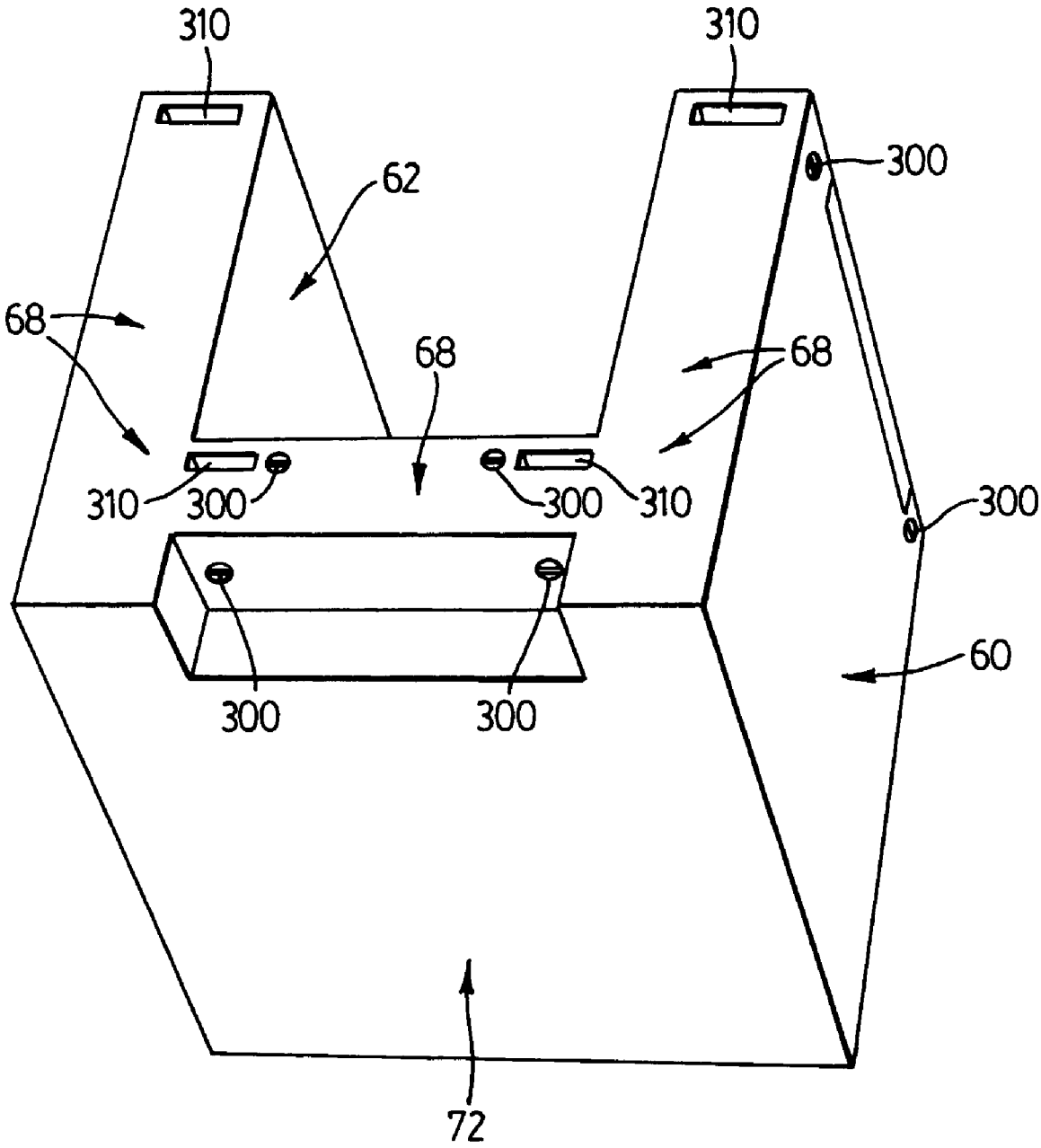
FIG. 6 is a bottom perspective view of the Chair of FIG. 4.
Figure 24:
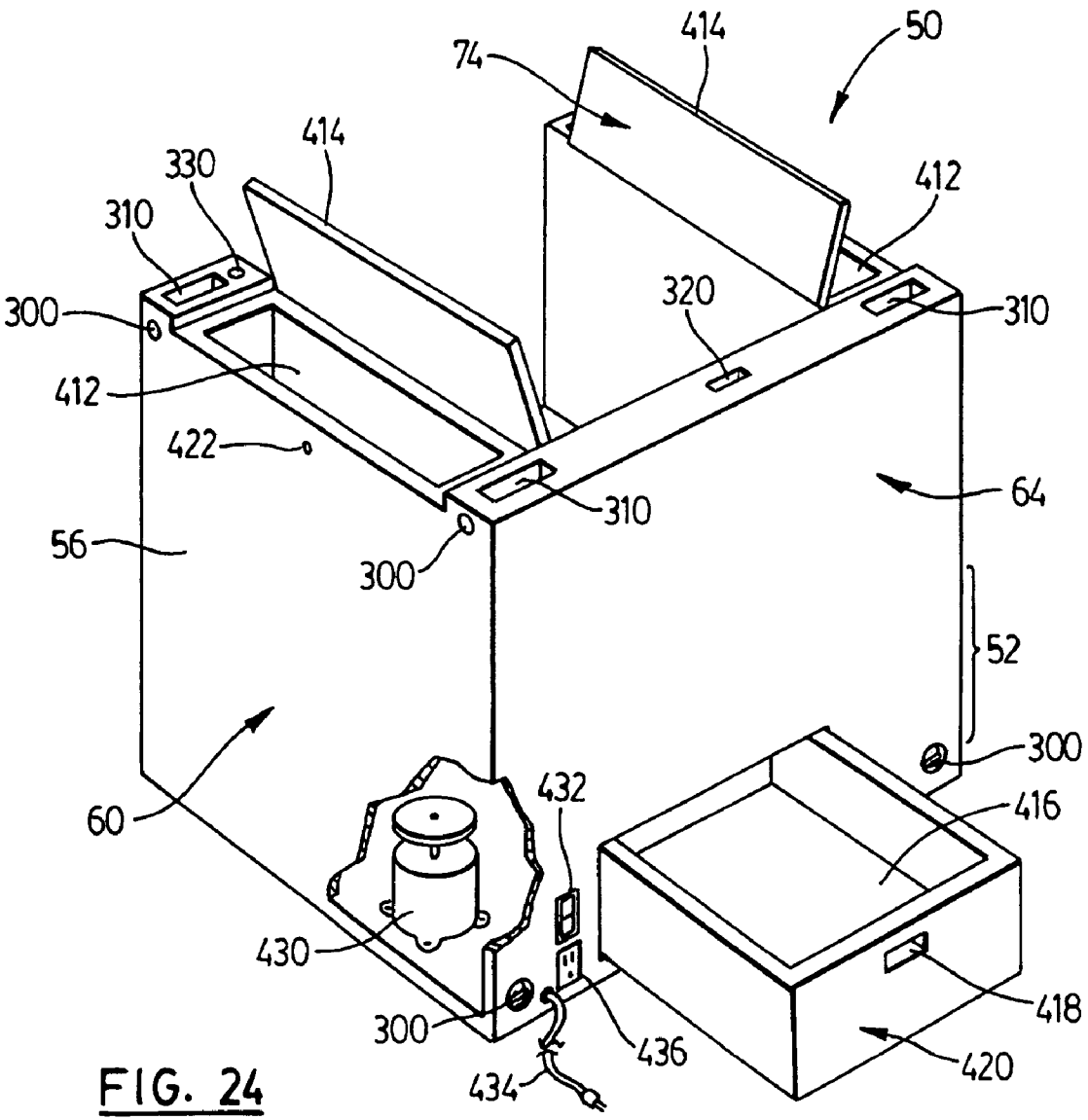
FIG. 24 is a rear perspective view of the chair of FIG. 4 partially at away and illustrating a storing means, an electrical outlet, a conducting means, a switch and a vibrating means.

The chair 50 has the following surfaces as illustrated in FIGS. 3, 6 and 24: an outer side chair surface 60, an inner side chair surface 62, an outer rear chair surface 64, an inner rear chair surface 66, a front chair surface 68, a top chair surface 70, a bottom chair surface 72, a top arm rest surface 74, and a top back support surface 76.

Figure 26:
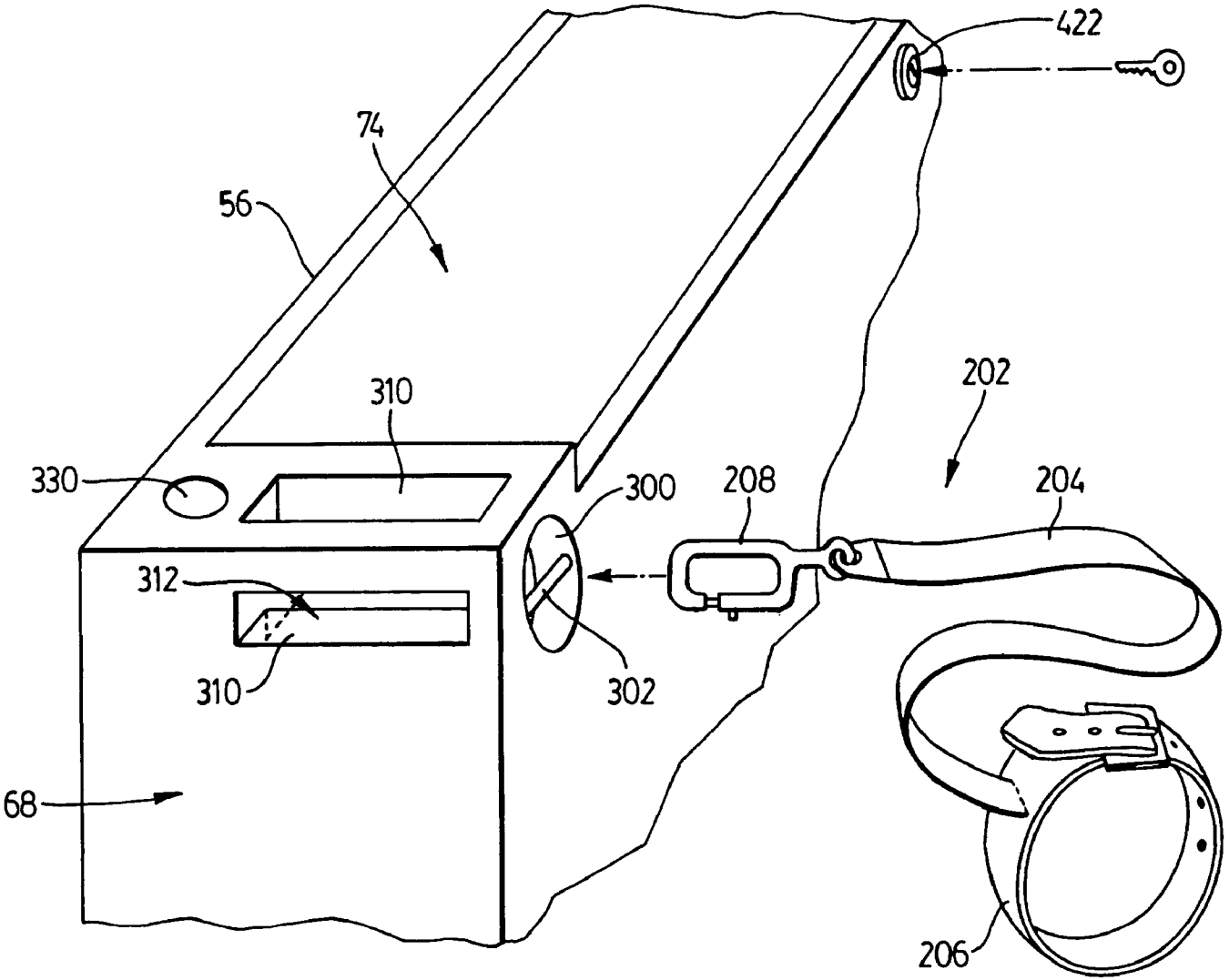
FIG. 26 is a perspective view of the arm rest of the chair of FIG. 4 illustrating attachment points according to the present invention.

Shown in FIG. 26 is a shackle 202 for securing the limbs of a person. The shackle 202 is one of the "accessories" referred to above and may include a strap 204 having one of its ends attached to an adjustable wrist/ankle band 206 for engaging the limbs of a person, and the other end is attached to a fastener 208 for engaging a bar attachment point 300.

Figures 29, 30, 31, 32:
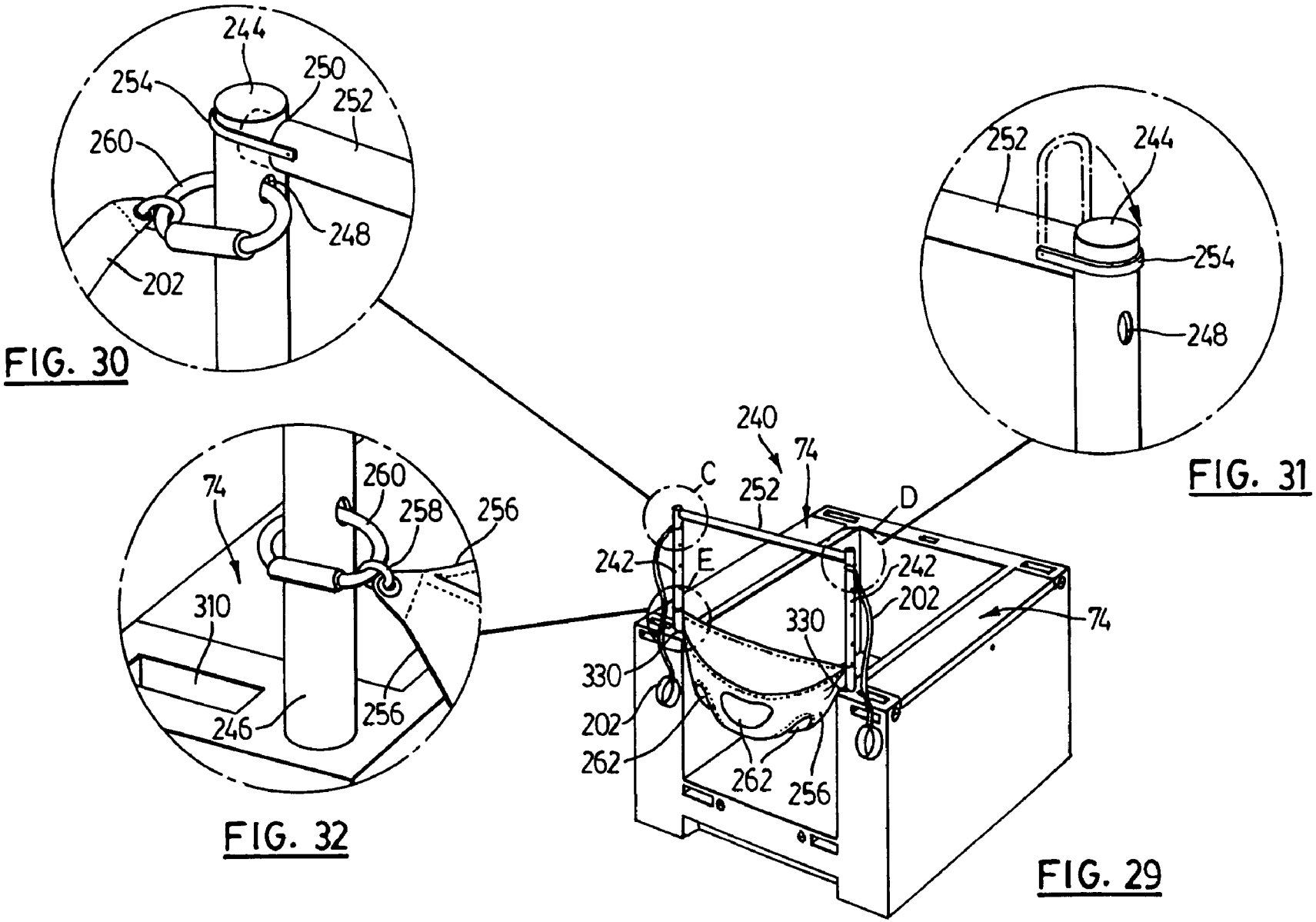
FIG. 29 is a perspective view corresponding to FIG. 28 illustrating the swing is attached thereto.
FIG. 30 is an enlargement of the encircled area identified by reference C in FIG. 29.
FIG. 31 is an enlargement of the encircled area identified by reference D in FIG. 29.
FIG. 32 is an enlargement of the encircled area identified by reference E in FIG. 29.

Alternatively, the fastener 208 may be replaced by a link 260 that can be opened as illustrated by FIGS. 29 and 30.

As shown in FIG. 26, the bar attachment point 300 may be a bore which may be located on the Chair 50 with a diameter of about two inches with a horizontal bar 302 mounted there across. A bar attachment point such as the attachment point 300 may be located on the outer side chair surface 60, the outer rear chair surface 64, the front chair surface 68, and the bottom chair surface 72 as illustrated in FIGS. 4, 5, 6 and 24.

Figure 10:
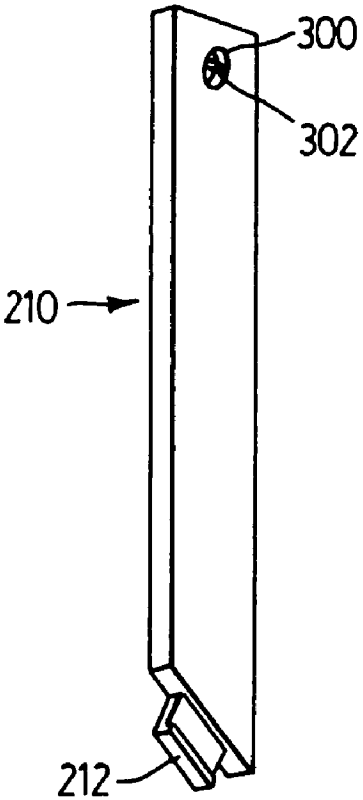
FIG. 10 is a perspective view corresponding to FIG. 8.
Figure 9:
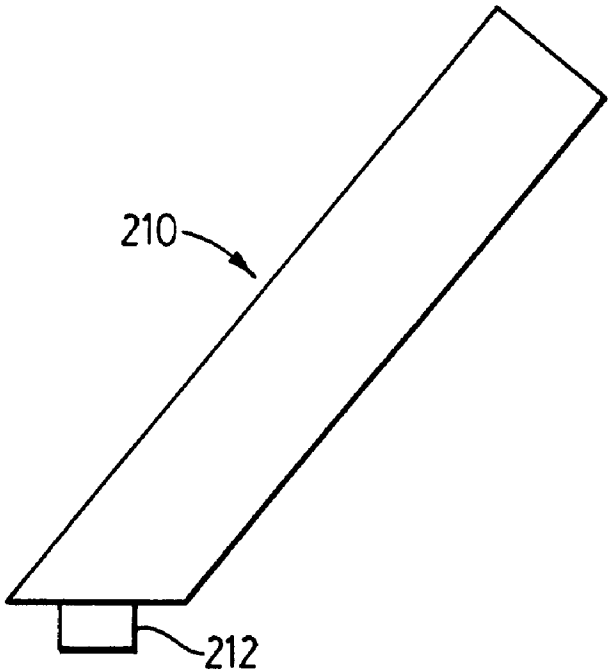
FIG. 9 is a rear elevational view corresponding to FIG. 8.
Figure 8:
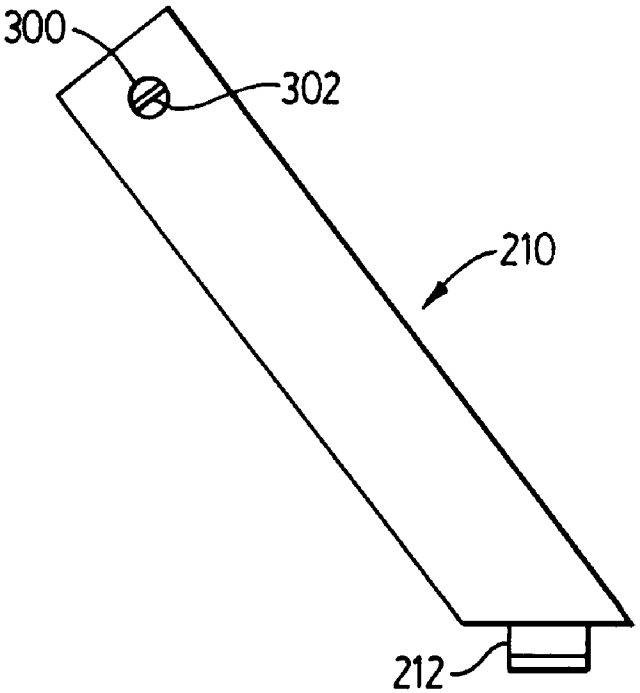
FIG. 8 is a front elevational view illustrating a cross-board according to the present invention.
Figure 22:
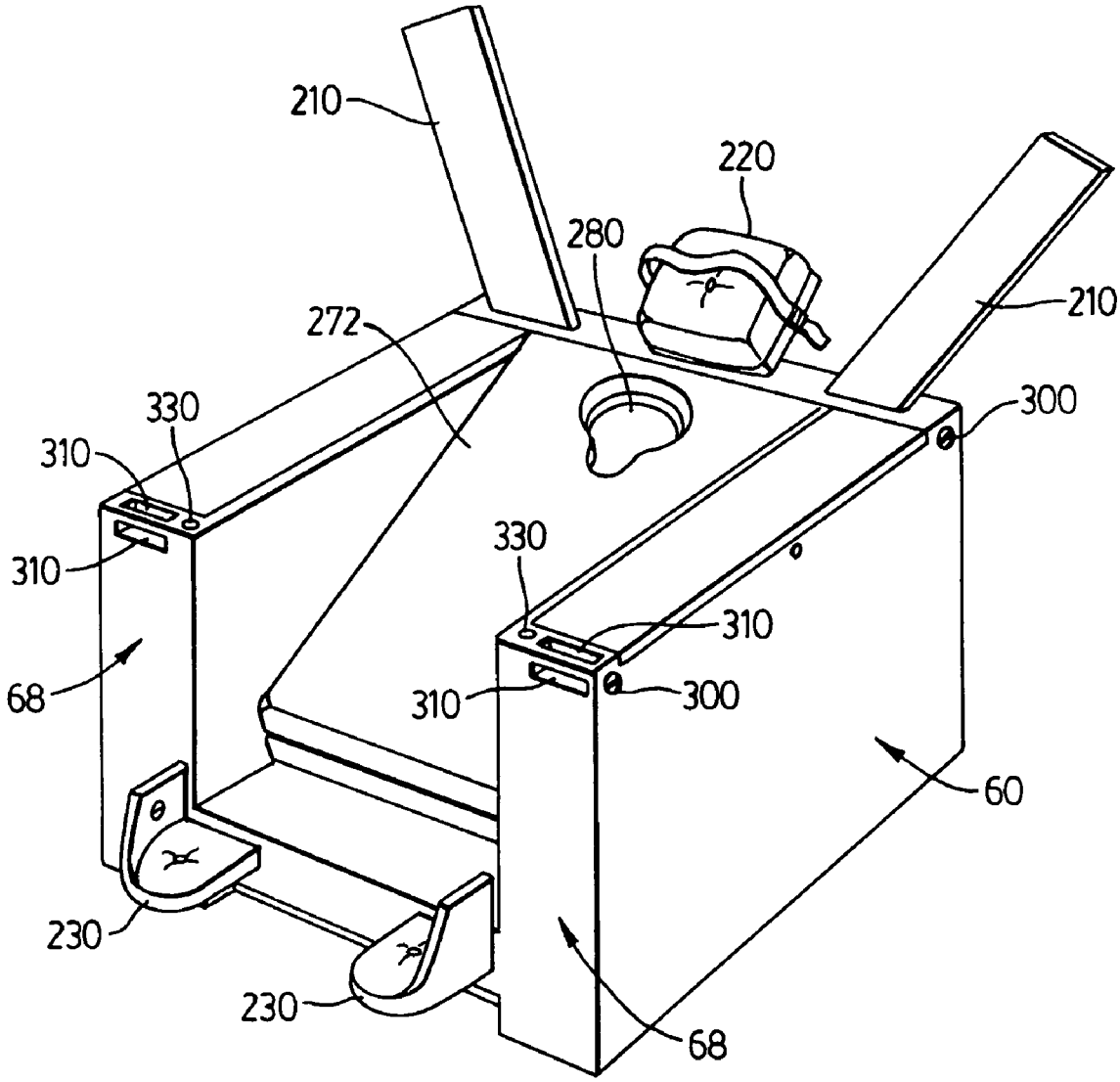
FIG. 22 is a perspective view of the chair of FIG. 4 illustrating the headrest, cross-boards, footpads and body board table attached thereto according to the present invention.
Figure 23:
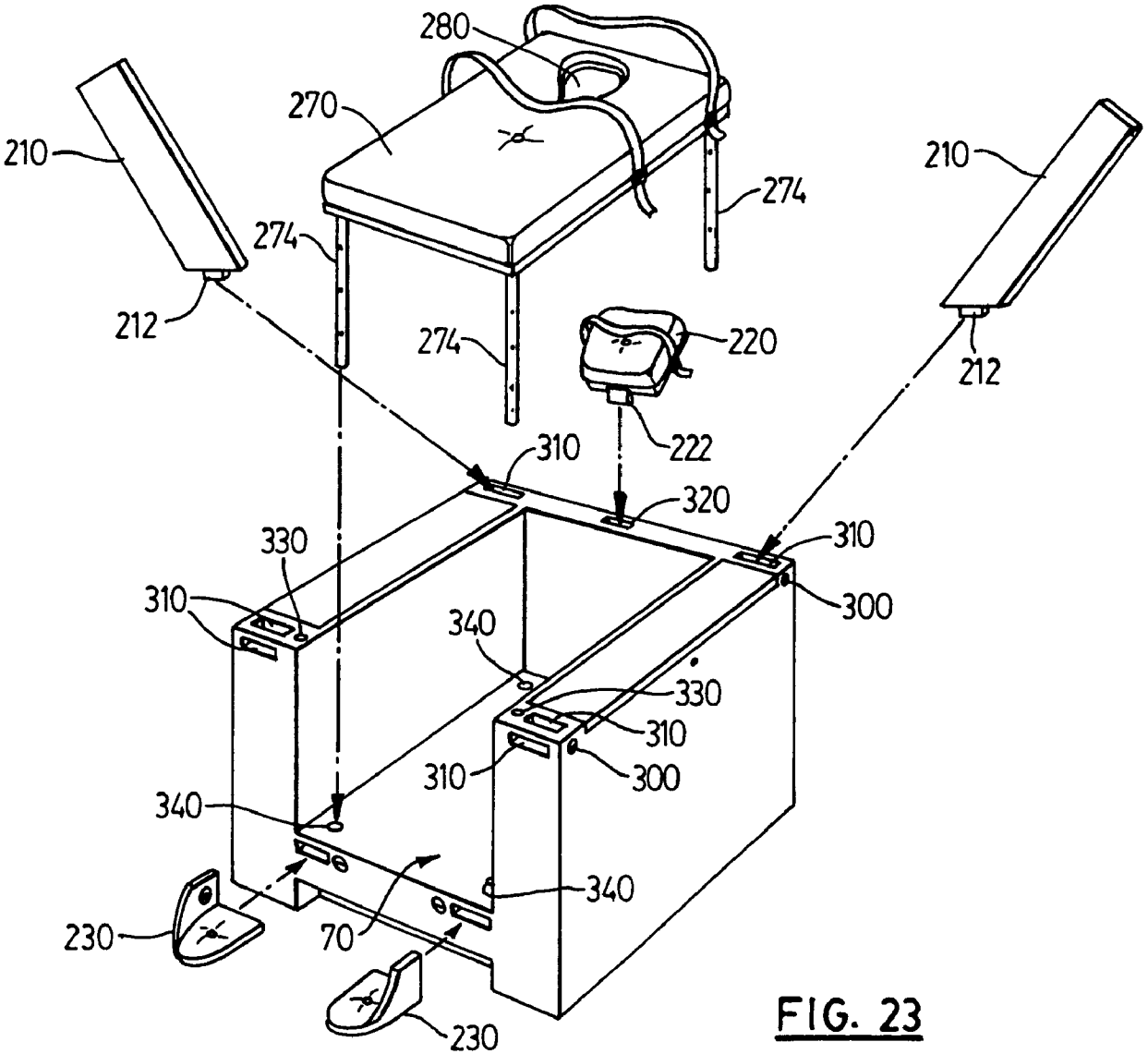
FIG. 23 is an exploded view corresponding to FIG. 22 but also illustrating strapping means attached thereto according to the present invention.

It is also possible for the bar attachment point 300 to be located on an accessory. For example, FIGS. 8, 9, and 10 illustrate a parallelpiped shaped cross-board 210, which may include a bar attachment point 300. The cross-board may include a hook 212 for engaging a hook slot 310 as best illustrated by FIG. 23. As shown in FIG. 26, the hook slot 310 may be on the front chair surface 68, and have an inner part 312 shaped to engage the hook 212, for locking the cross-board 210 in place when attached to the chair 50 as shown in FIG. 22.

As illustrated in FIG. 3, the hook slot 310 may be located on the top arm rest surface 74, the top back support surface 76 and the front chair surface 68.

Figure 11:
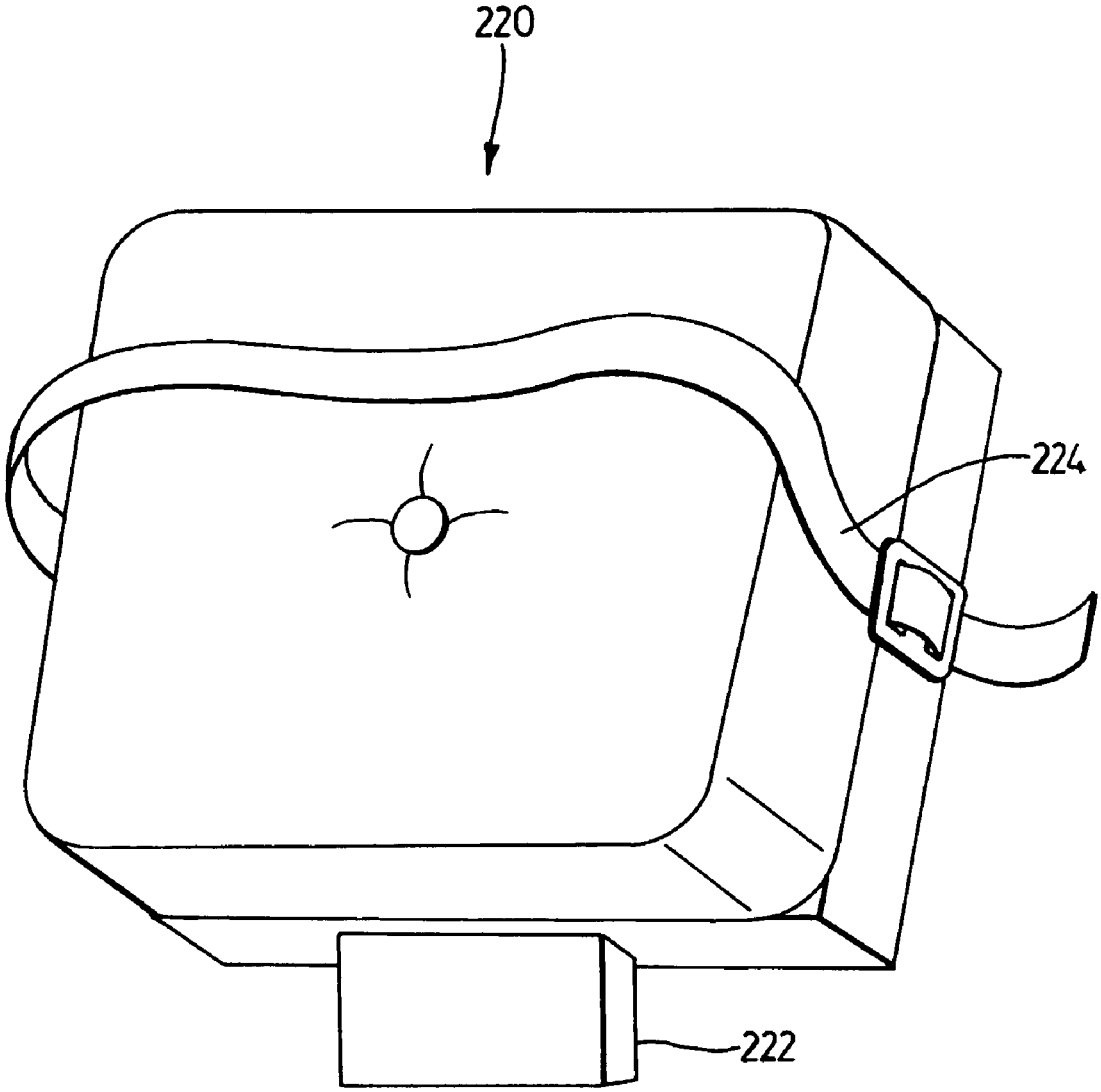
FIG. 11 is a perspective view illustrating a headrest according to the present invention.

Shown in FIG. 11 is a headrest 220 for providing support to a person's head. As illustrated in FIG. 11, the headrest 220 may be cuboid shaped, padded and upholstered with a suitable furniture material such as foam and leather respectively and may have an adjustable strap 224 attached thereto for securing a person's head.

As shown in FIGS. 11 and 23, the headrest 220 may have a projection 222 for attaching the headrest 220 to a rectangular socket 320. The rectangular slot 320 may be located on the top back support surface 76 as illustrated in FIG. 23.

Figure 12:
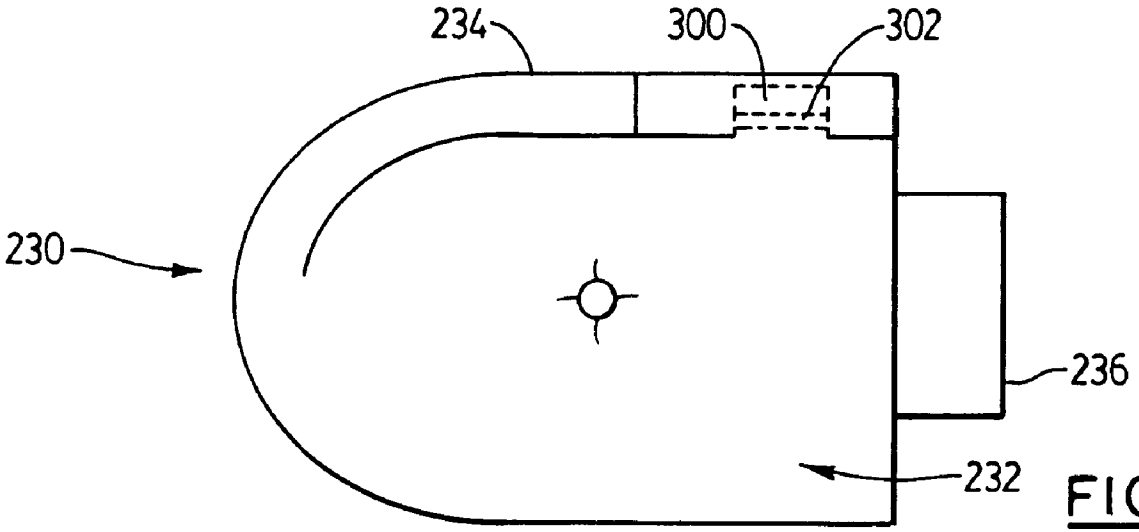
FIG. 12 is a top plan view illustrating a footpad according to the present invention.
Figure 14:
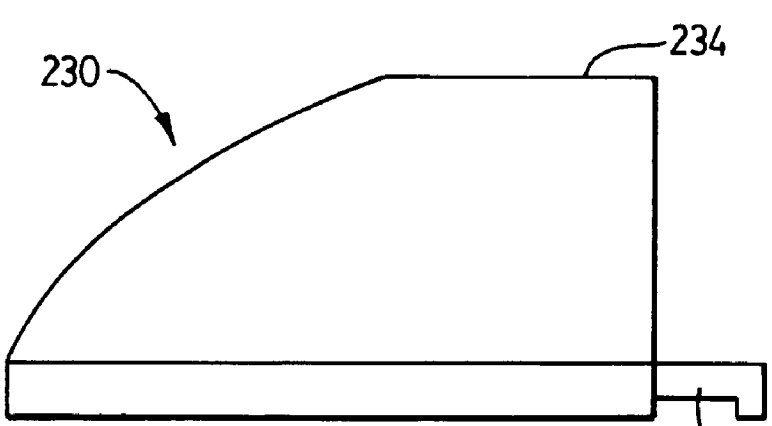
FIG. 14 is a side opposite end elevational view corresponding to FIG. 12.
Figure 13:
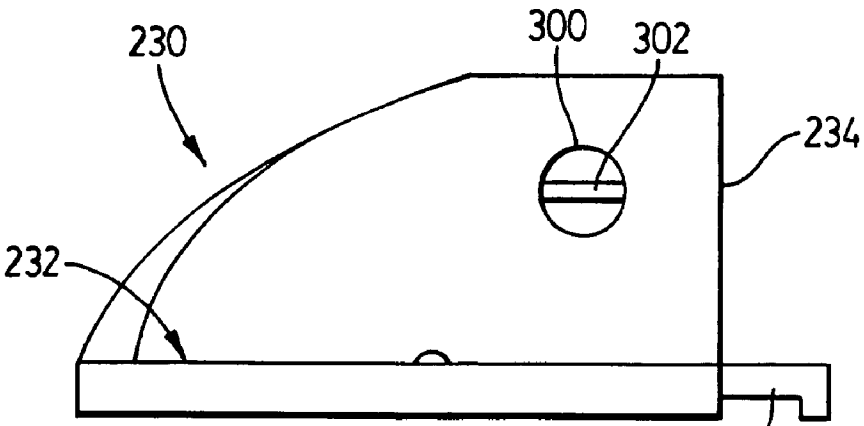
FIG. 13 is a side end elevational view corresponding to FIG. 12.

Shown in FIGS. 12, 13 and 14 is a footpad 230 for providing support to a person's foot and depending on where the footpad is attached, it may alternatively provide support to a person's knee. The footpad 230 may be rectangular shaped having a generally flat surface 232. The flat surface 232 may be padded and upholstered by any material suitable for furniture use, such as foam and leather respectively. The footpad 230 may also have a foot guard 234 attached for providing additional support to a person's foot or knee. The foot guard 234 may have a bar attachment point 300 for attaching additional accessories such as the shackle 202 as illustrated in FIG. 39.

Figure 39:
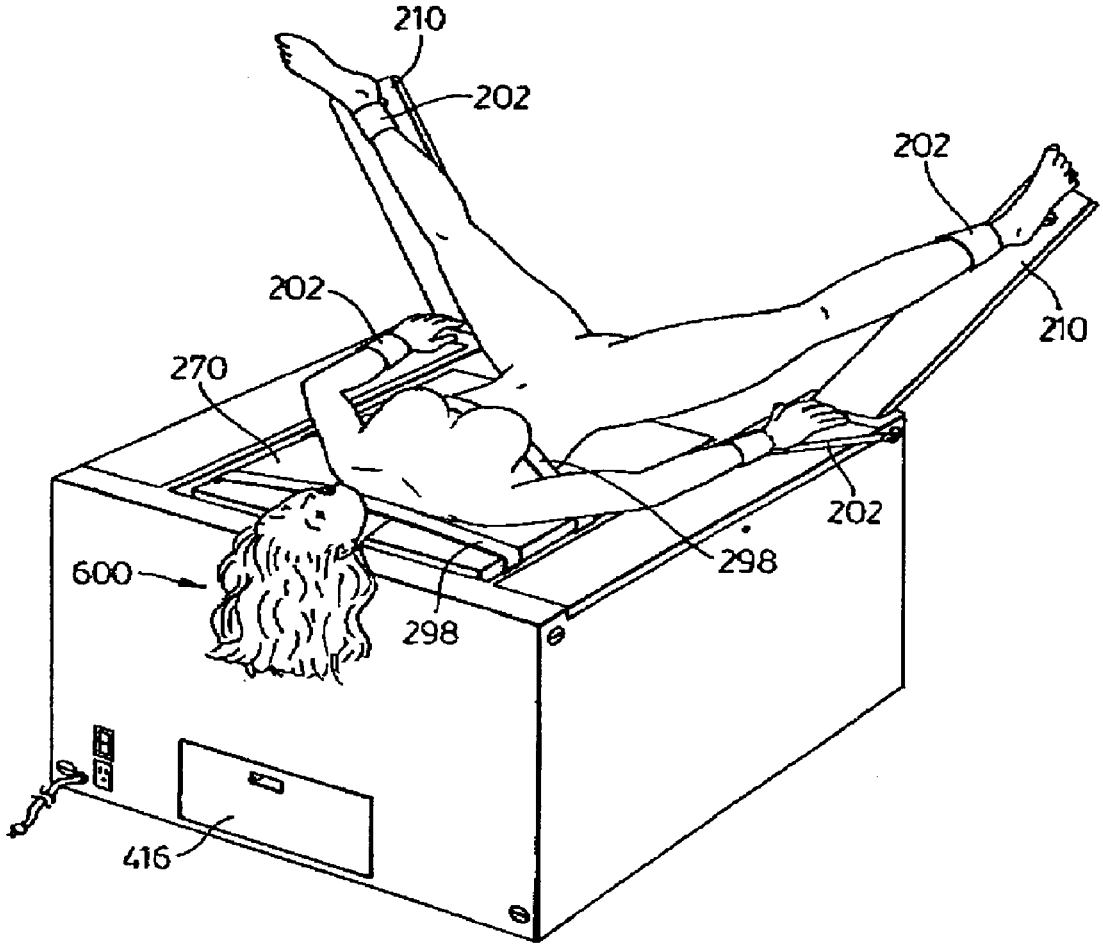
FIG. 39 is a rear perspective view corresponding to FIG. 38 but illustrating the cross-boards attached to an alternate attachment point and the headrest removed according to the present invention.
Figure 40:
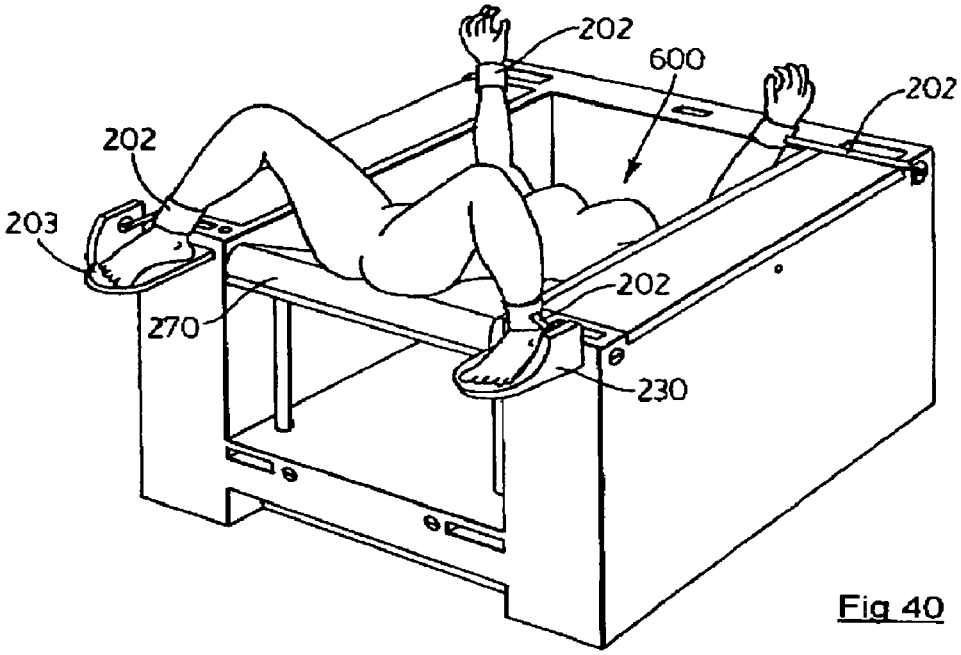
FIG. 40 is a perspective view corresponding to FIG. 39 but illustrating the body board table in a different configuration and the headrest and strapping means removed according to the present invention.
Figure 41:
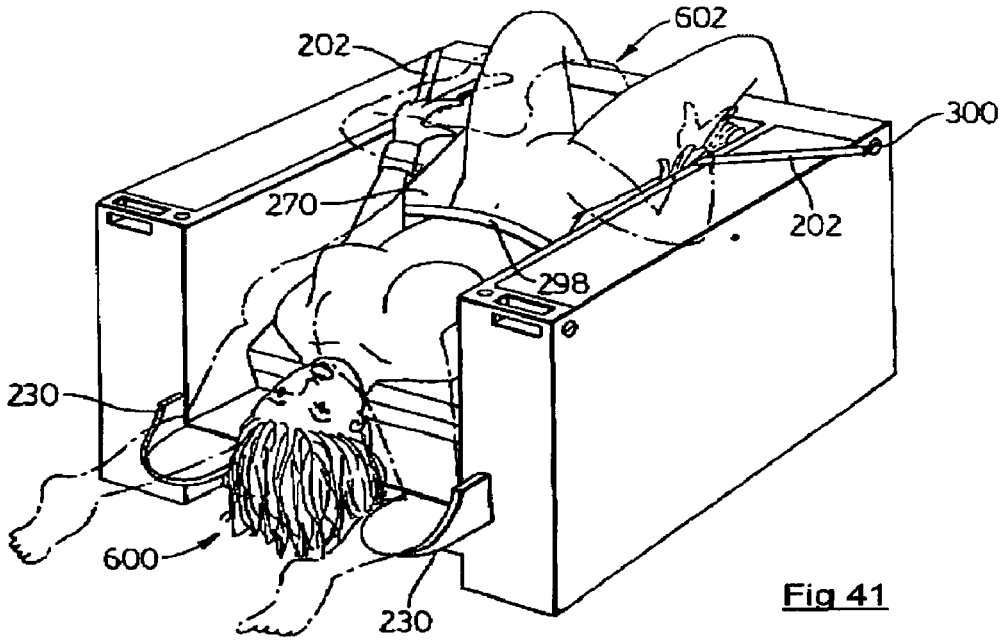
FIG. 41 is a perspective view corresponding to FIG. 39 but illustrating the footpads and shackles attached to alternate attachment points and the headrest removed according to the present invention.
Figure 42:
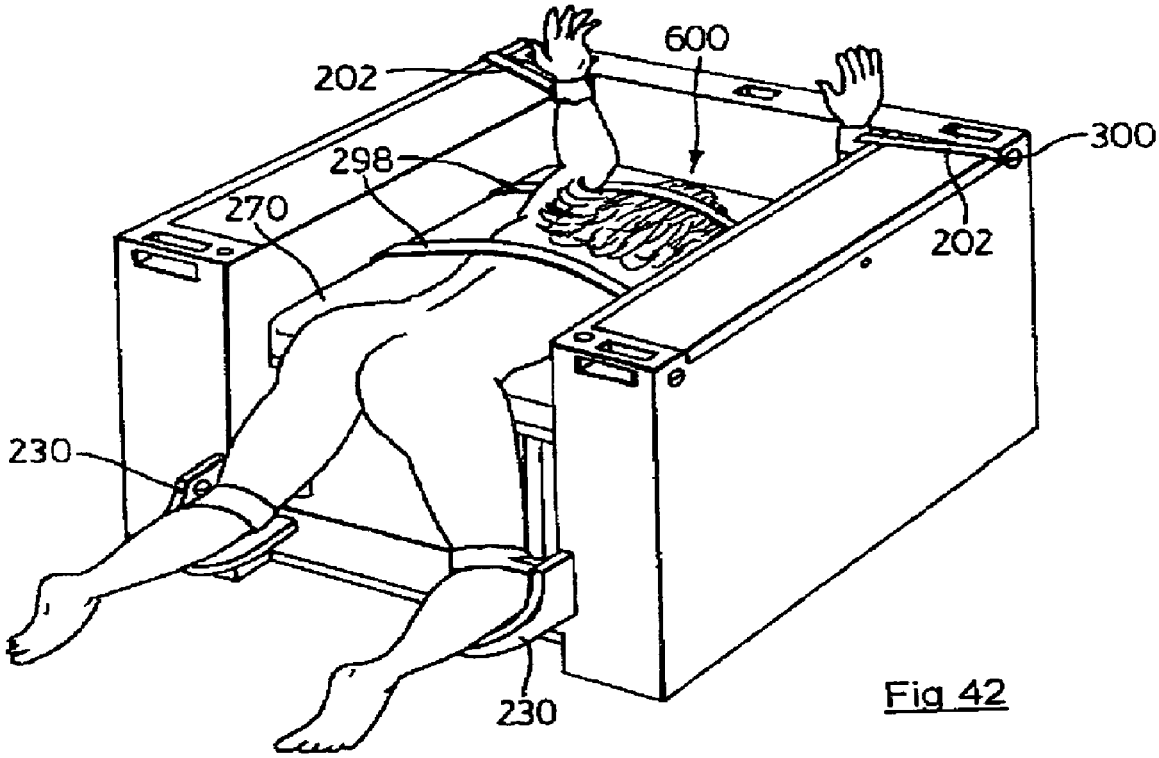
FIG. 42 is a perspective view corresponding to FIG. 43 but illustrating the body board table in an alternate configuration and the strapping means attached to an alternate attachment point according to the present invention.
Figure 43:
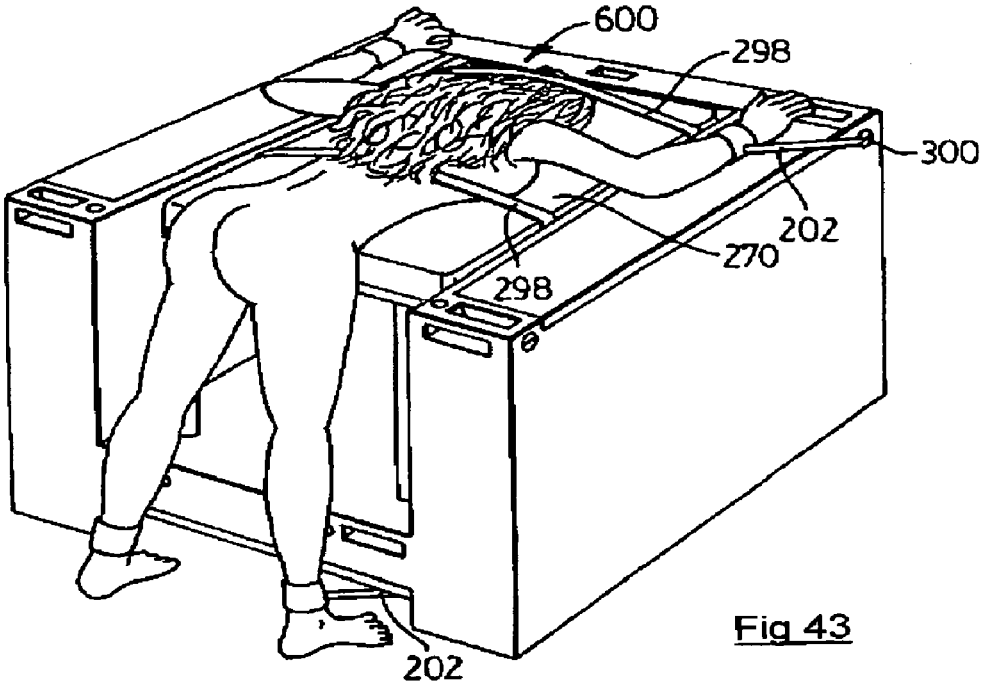
FIG. 43 is a perspective view of the chair of FIG. 20 but illustrating the shackles and strapping means attached thereto.

As shown in FIGS. 12, 13 and 14, the footpad 230 may have a hook 236, having the same or similar dimensions as the hook 212 for engaging a hook slot 310 as shown in FIGS. 39, and 43.

Figure 28:
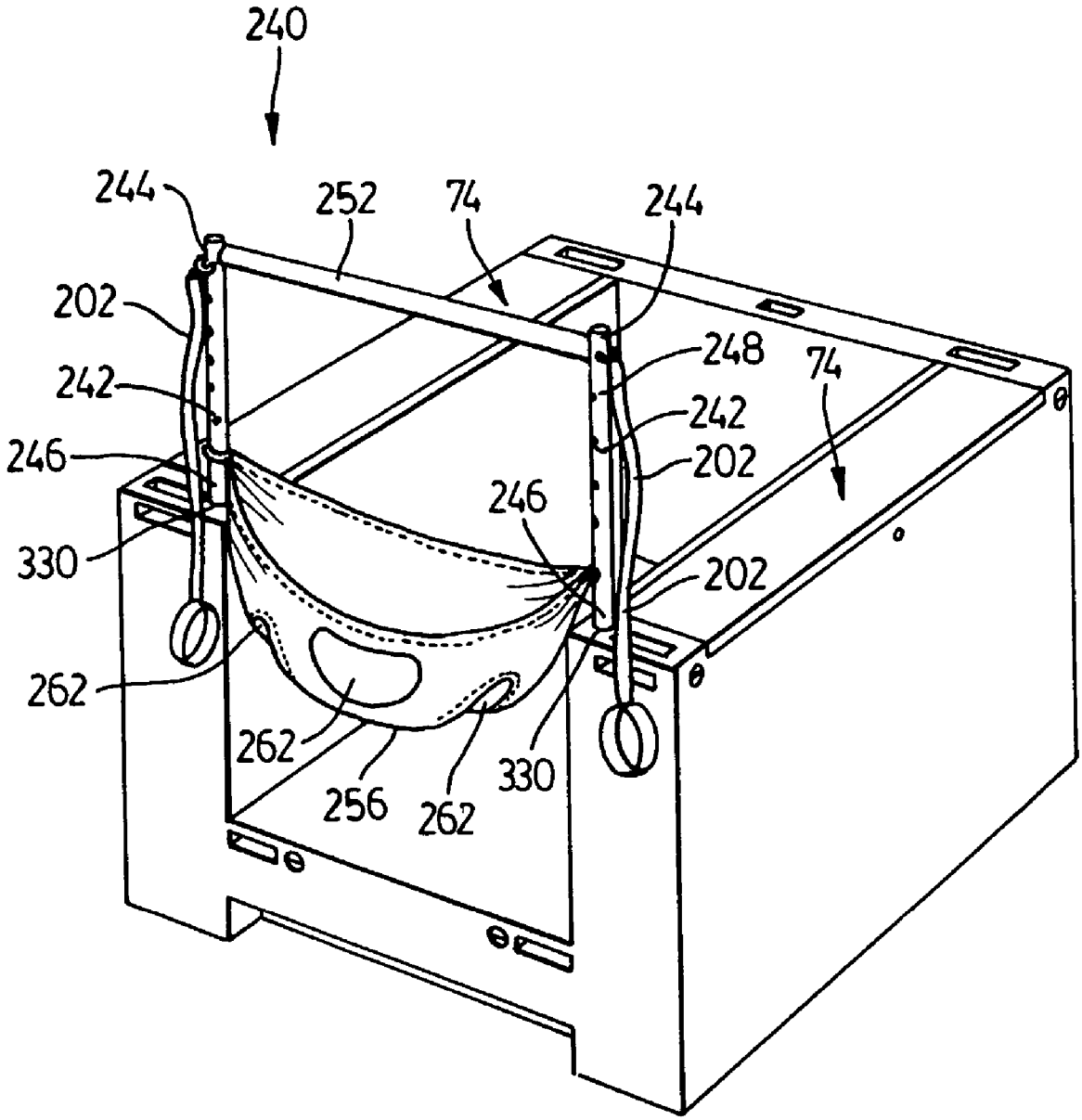
FIG. 28 is a perspective view of the chair of FIG. 4 illustrating a swing attached thereto.

A swing 240 may be attachable to the chair 50 as shown in FIGS. 28 and 29. The swing 240 may consist of two rigid tubular poles 242, each having a top end 244 and a bottom end 246.

As shown in FIGS. 28, 29, 30 and 32, the tubular poles 242 may have a plurality of spaced apart holes 248 extending through it for providing a means to attach additional accessories such as the shackle 202 and a swing seat 256.

As shown in FIG. 30, the tubular pole 242 may have a hole 250 extending into it, located at the top end 244 for attaching a horizontal bar 252 to provide greater rigidity to the swing 240. The horizontal bar 252 may have a latch 254 located on each of its end as shown in FIGS. 30 and 31, for securing the horizontal bar 252 to the top end 244 on each respective tubular pole 242.

Figure 27:
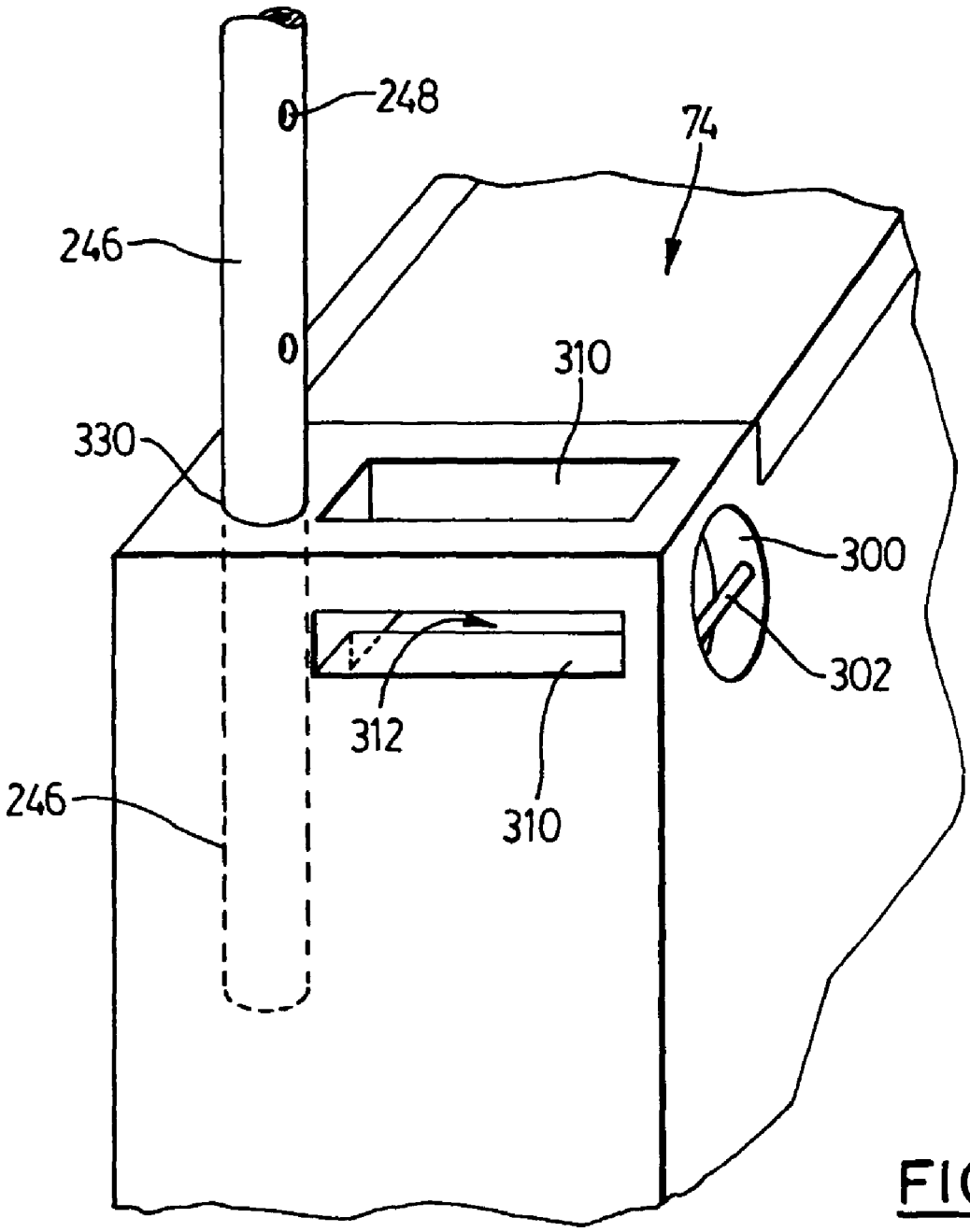
FIG. 27 is a perspective view of the arm rest of the chair of FIG. 4 illustrating an alternate embodiment attachment point according to the present invention.
Figure 33:
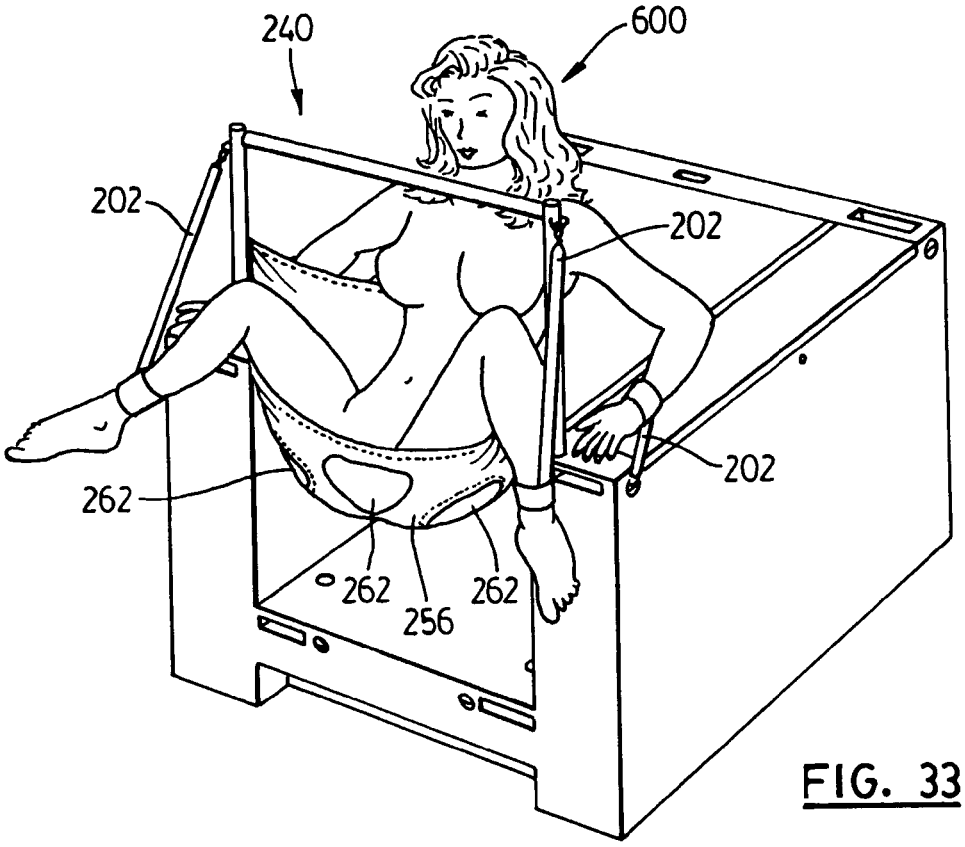
FIG. 33 is a perspective view of the chair of FIG. 4 illustrating the swing and shackles attached thereto.
Figure 34:
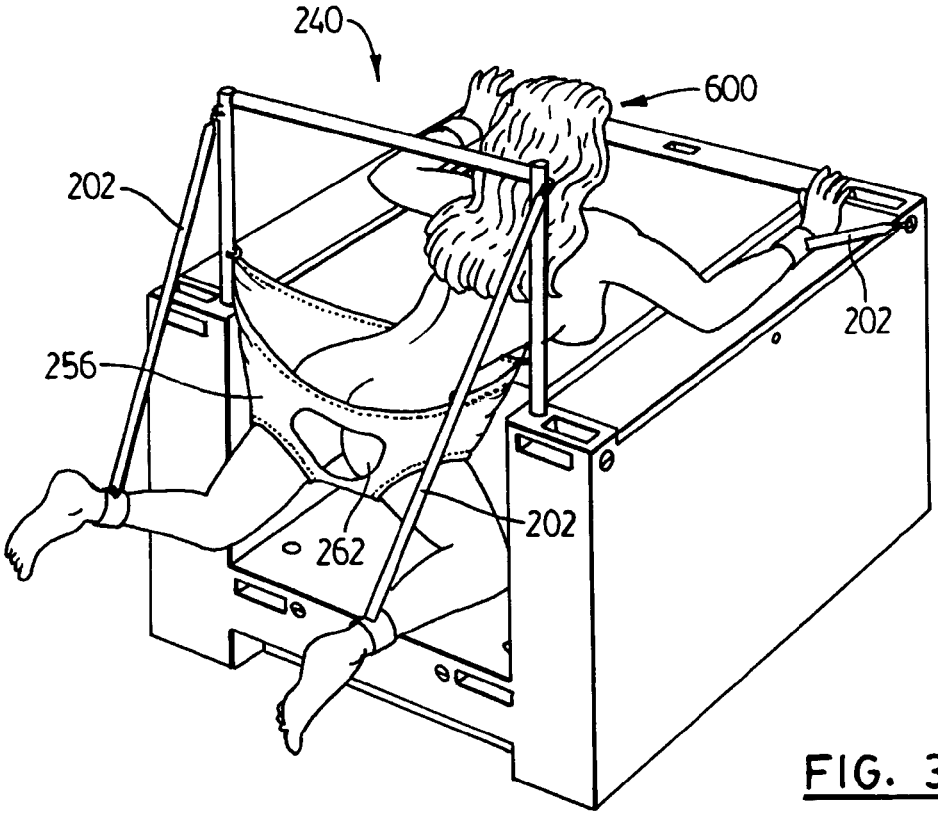
FIG. 34 is a perspective view corresponding to FIG. 33 but illustrating the shackles attached to an alternate attachment point according to the present invention.
Figure 35:
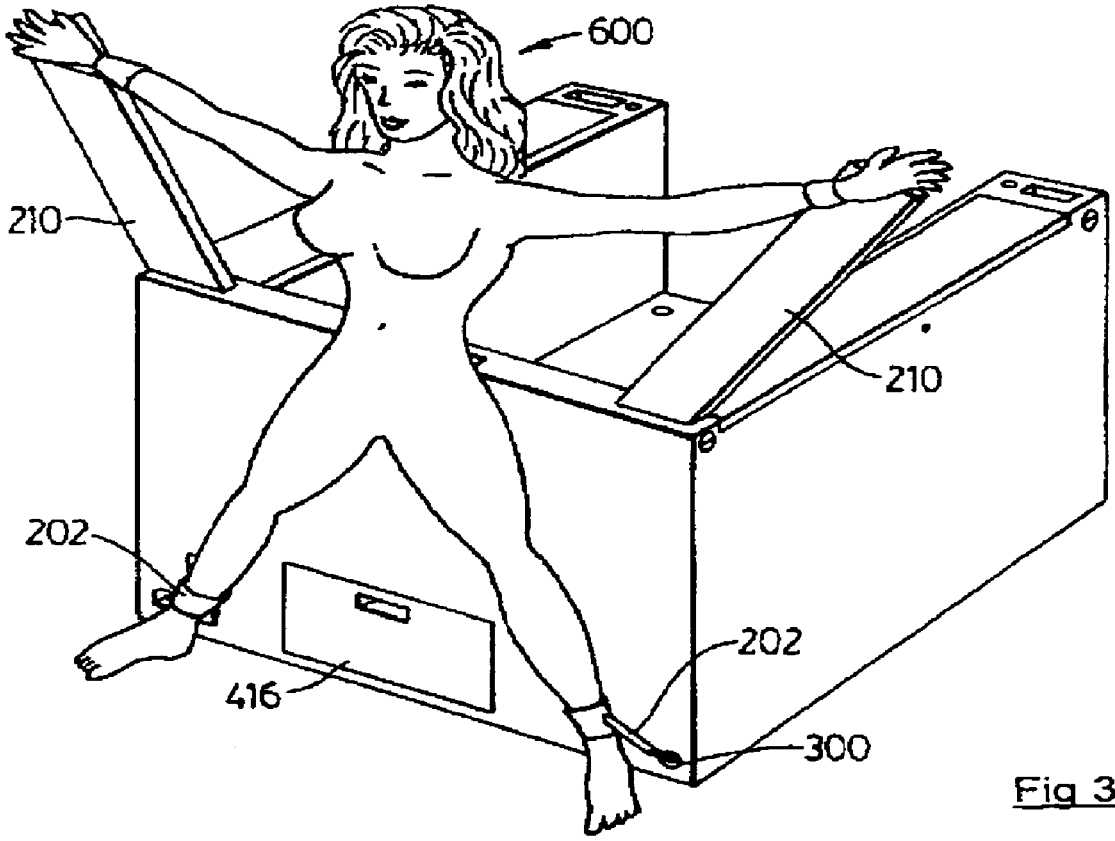
FIG. 35 is a rear perspective view of the chair of FIG. 4 illustrating the shackles and cross-boards attached thereto.
Figure 36:
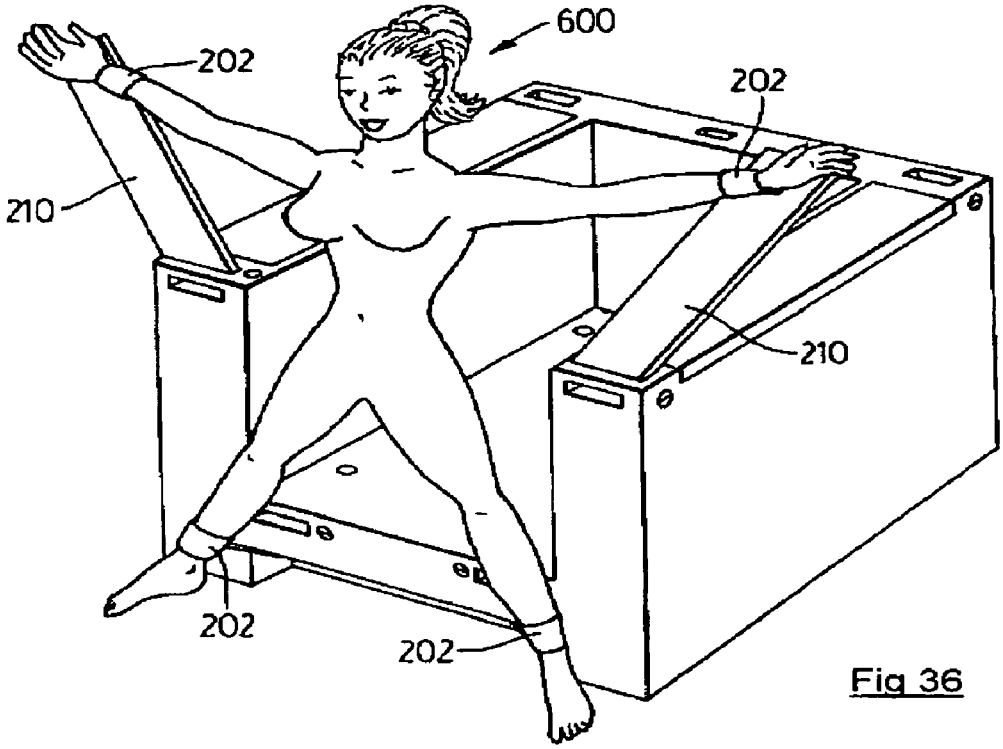
FIG. 36 is a perspective view corresponding to FIG. 36 but illustrating the shackles and cross-boards attached to alternate attachment points according to the present invention.
Figure 37:
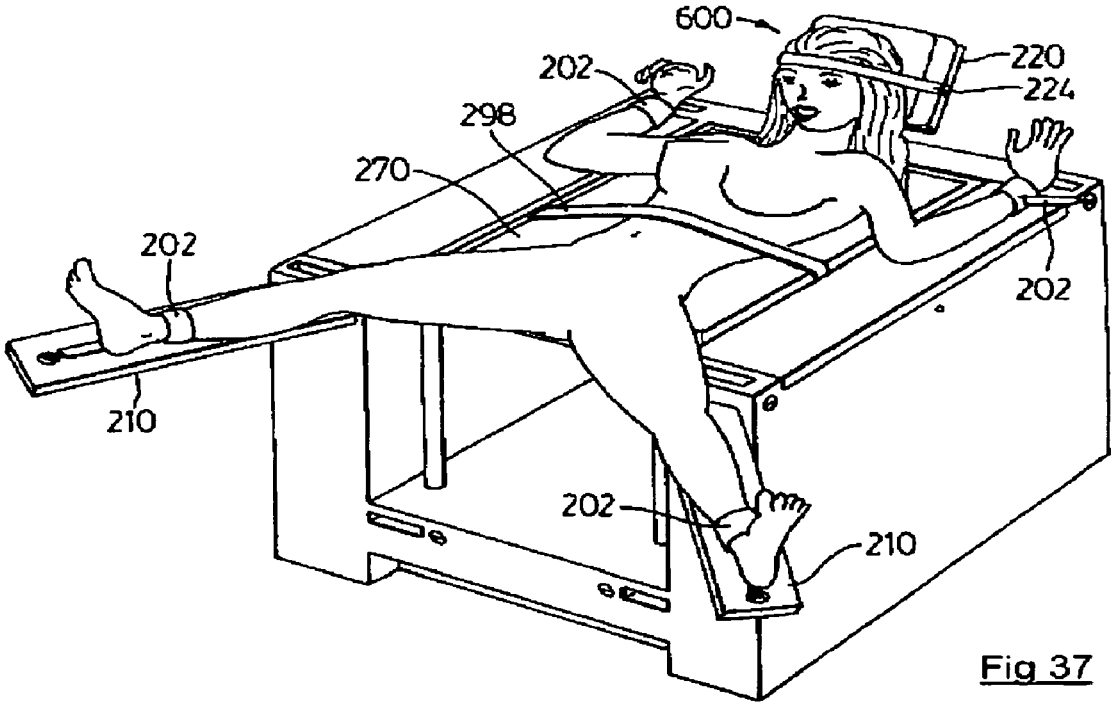
FIG. 37 is a perspective view of the chair of FIG. 4 illustrating the headrest, shackles, strapping means, body board table and cross-boards attached thereto.
Figure 38:
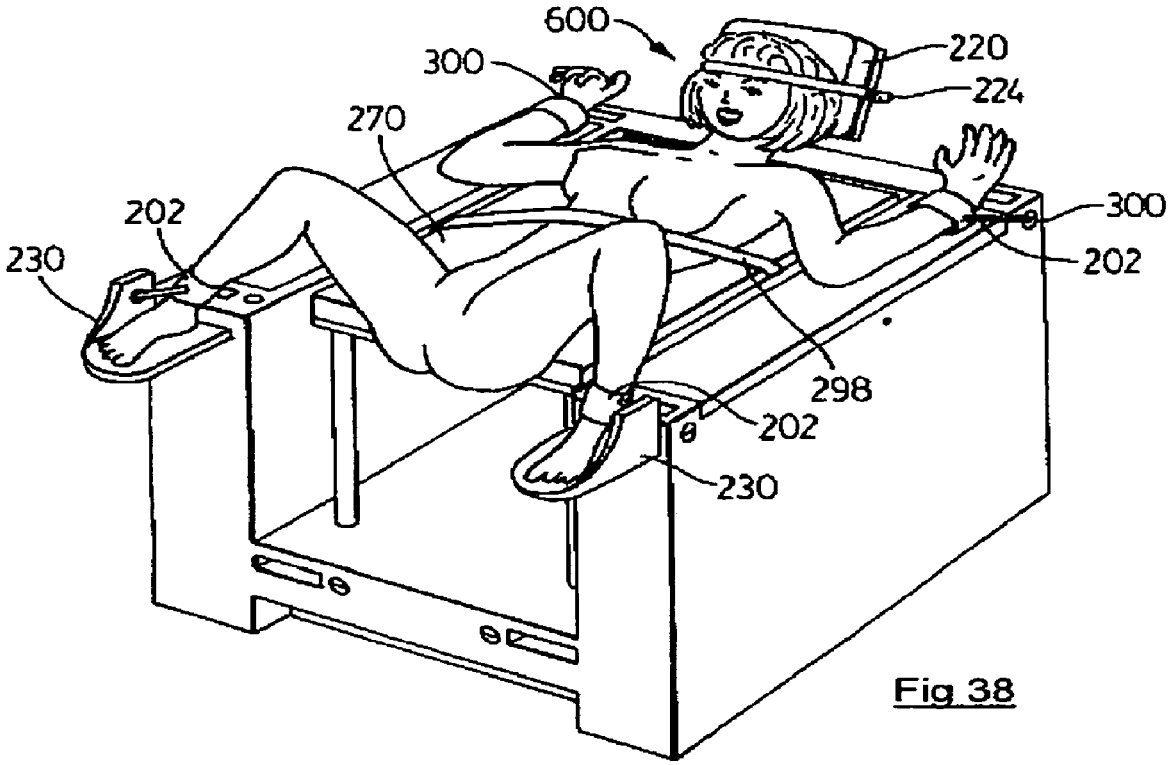
FIG. 38 is a perspective view corresponding to FIG. 38 but illustrating the footpads attached thereto in place of the cross-boards according to the present invention.

The bottom end 246 of each tubular pole 242 may be inserted into a socket 330 located on the top armrest surface 74 as shown in FIG. 27. The socket 330 has a diameter slightly larger than the diameter of the tubular pole 242 and a depth sufficient to receive the bottom end 246 such that when a person engages the swing 240 as shown in FIGS. 33, 34, and 35, the swing 240 is prevented from detaching from the chair 50.

As shown in FIG. 29, the swing seat 256 may have a semi-spherical shape, made of a durable material such as leather. The swing seat 256 may have two links 258, one located on each side, as shown in FIGS. 29 and 32. The link 258 is attachable to a link 260 that can be opened. As shown in FIG. 32, the link 260 engages each pole 242 respectively, forming the seating surface for the swing 240.

As shown in FIGS. 29, 33, 34 and 35, the swing seat 256 may have three apertures 262 for accommodating a person's limbs and facilitating two persons engaging in sexual activity when one person is on the swing 240.

Figure 45:
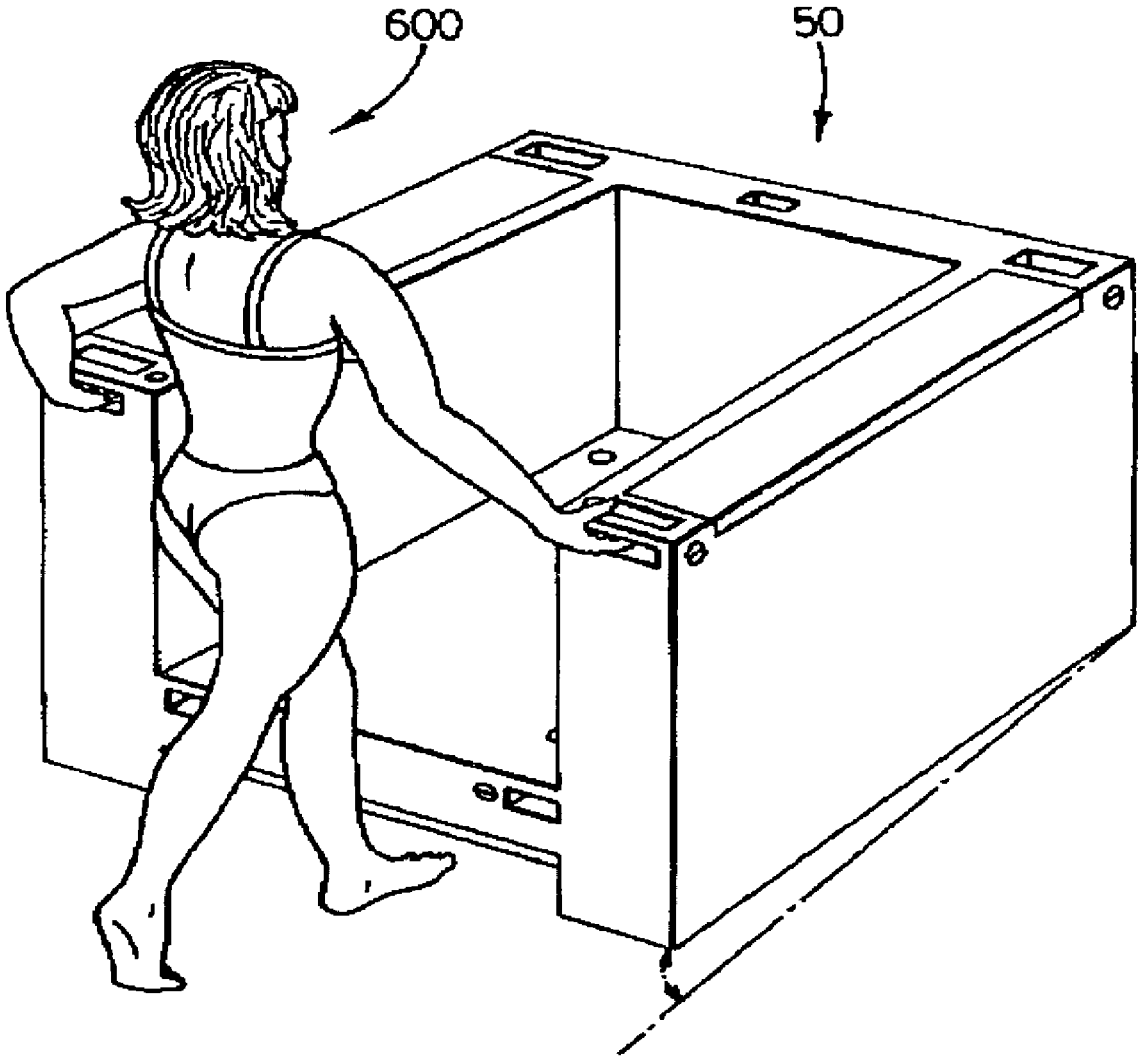
FIG. 45 is a perspective view of the chair of FIG. 4 illustrating the chair being moved.

As shown in FIG. 45, the chair 50 may be used in association with a kneeler 264, which may be padded and upholstered with any material suitable for furniture such as foam and leather respectively.

Figure 15:
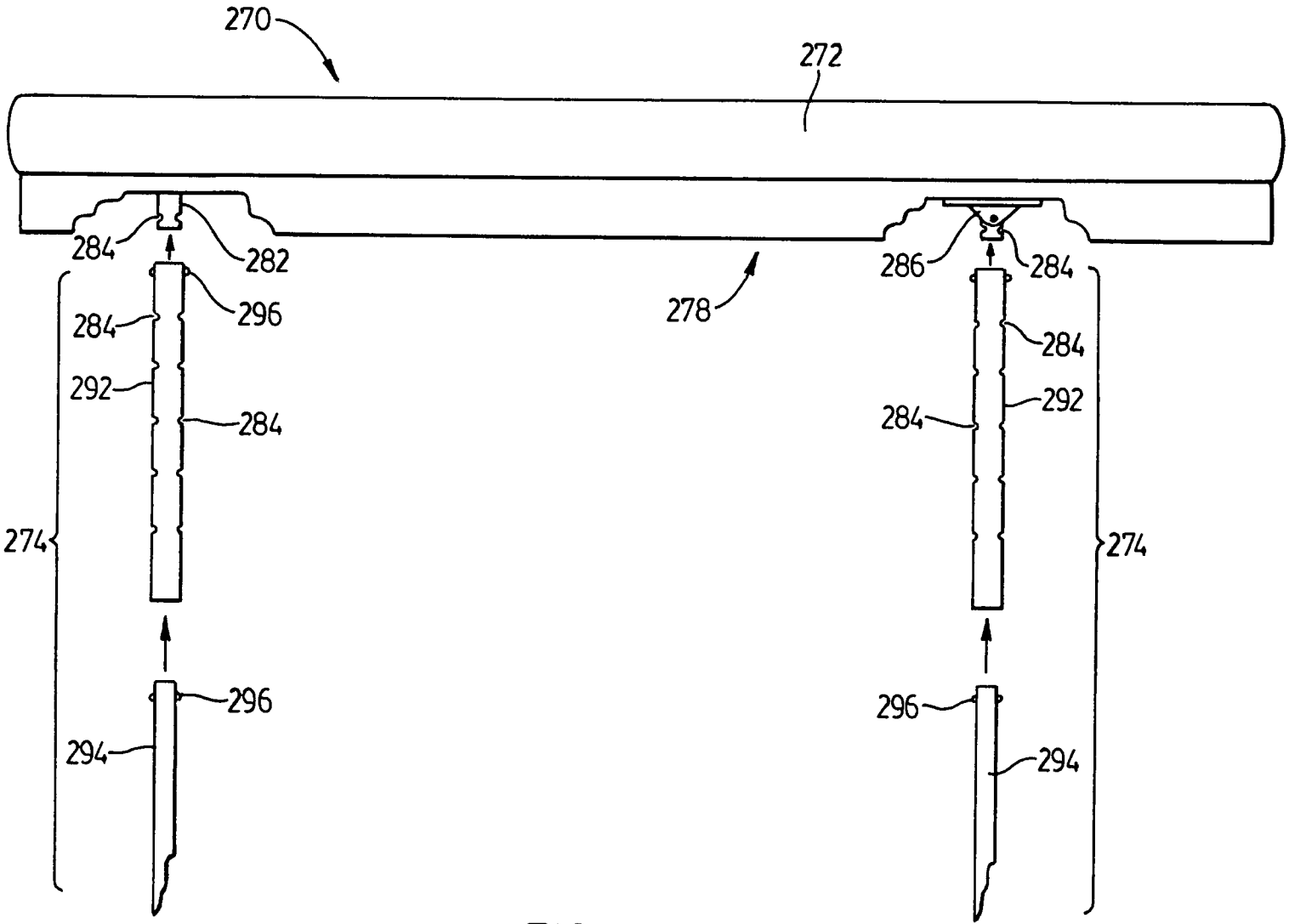
FIG. 15 is an exploded view illustrating a body board table according to the present invention.

Shown in FIG. 15 is a body board table 270 that may be partially collapsible. The body board table 270 may have a body board 272, and four support legs 274 attachable to the body board 272.

Figure 16:
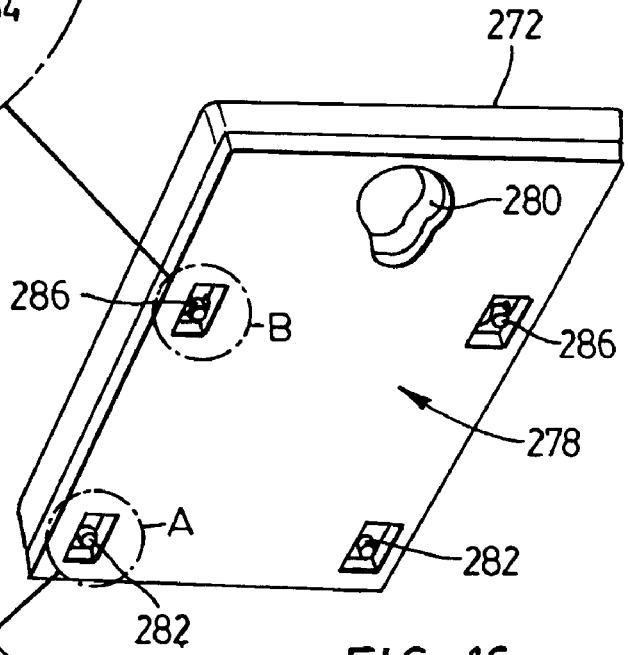
FIG. 16 is a perspective view of the body board table of FIG. 15 without the support member coupled thereto.
Figure 17:
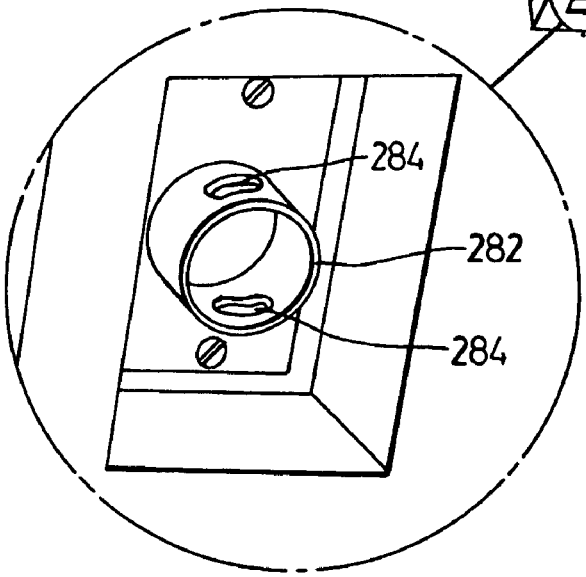
FIG. 17 is an enlargement of the encircled area identified by reference A in FIG. 16.
Figure 19:
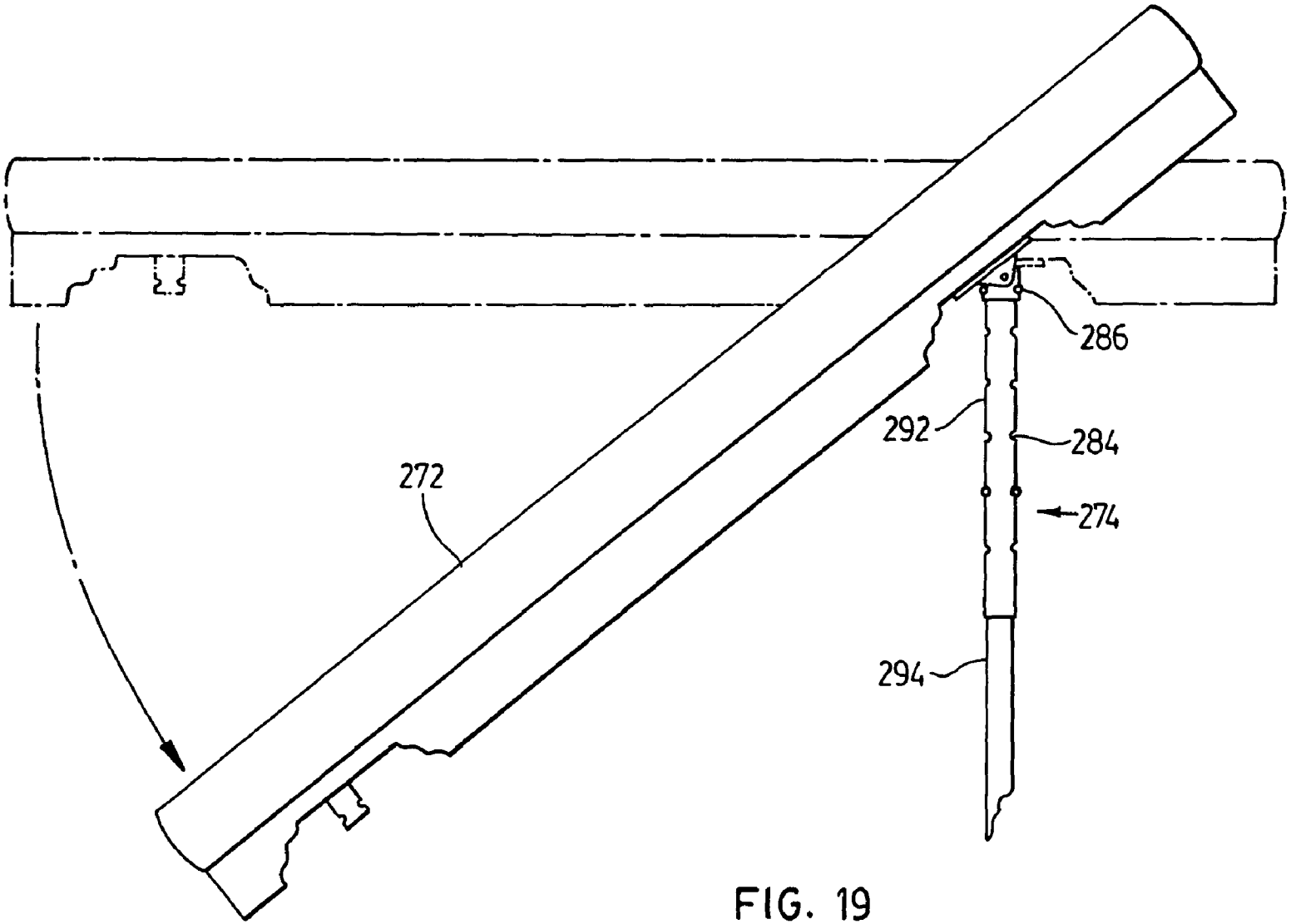
FIG. 19 is a side end elevational view of the body board table of FIG. 15.

As shown in FIG. 16, the body board 272 may be rectangular in shape, having a slot 280 for accommodating a person's face. The body board table 270 may also have two sockets 282 and two pivotal sockets 286, mounted on a bottom table surface 278 as shown in FIG. 16. As shown in FIG. 17, the sockets 282 may be tubular, mounted on the bottom table surface 278 and receive the respective support legs 274.

Figure 18:
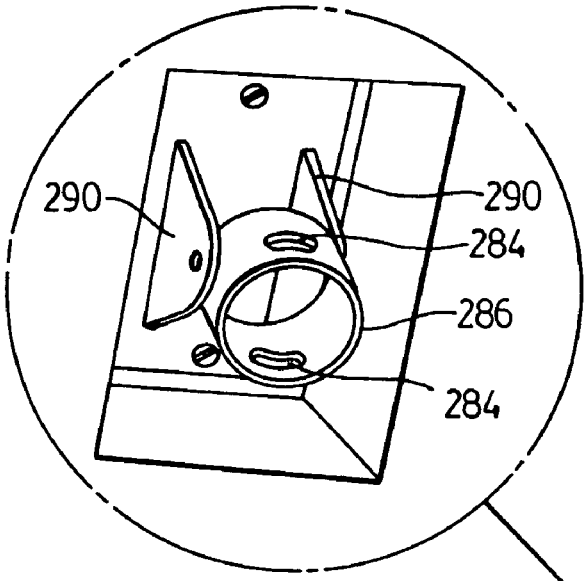
FIG. 18 is an enlargement of the encircled area identified by reference B in FIG. 16.

As shown in FIG. 18, the pivotal sockets 286 may also be tubular, receive the respective support legs 274 and be pivotally connected to two triangular shaped mounting means 290.

Figure 20:
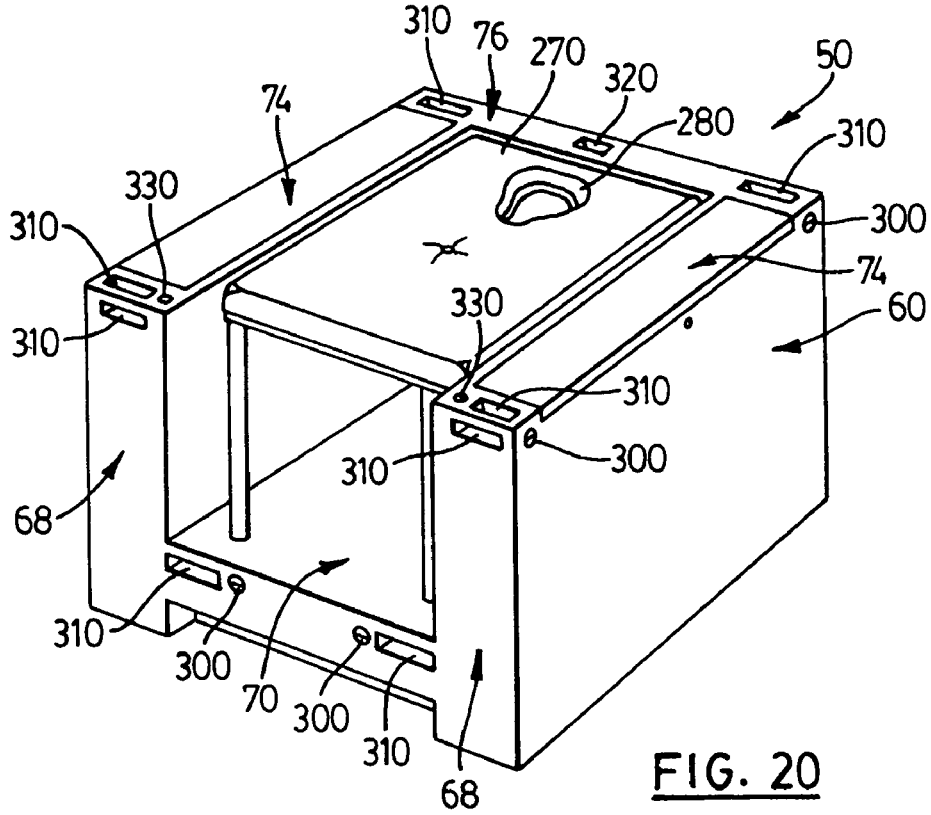
FIG. 20 is a perspective view of the Chair of FIG. 4 illustrating the body board table attached thereto.
Figure 44:
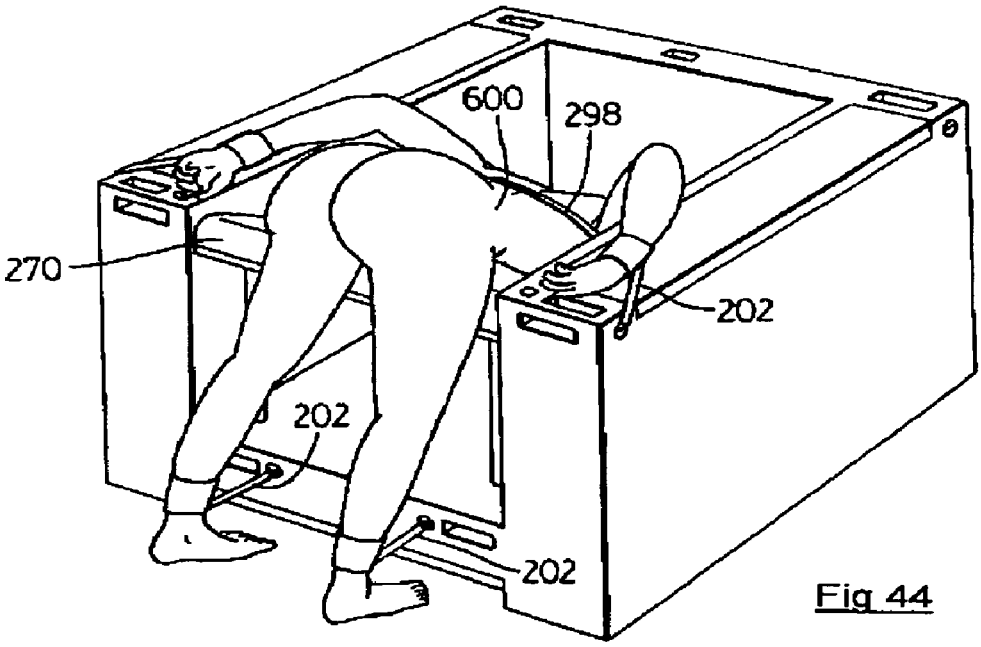
FIG. 44 is a perspective view corresponding to FIG. 46 but illustrating the shackles attached to alternate attachment points and the body board table in an alternate configuration according to the present invention.

As shown in FIG. 15, each support leg 274 may include a detachable upper leg 292 slidably connected to a lower leg 294. The upper leg may have a plurality of spaced apart holes 284 as illustrated in FIG. 15 for engaging a spring biased extensible pin 296 located on the lower leg 294 for locking the lower leg 294 to the upper leg 292. The upper leg 292 may also have a spring biased extensible pin 296 located at its top end for engaging with its respective socket 282 and pivotal socket 286. The resulting structure of the support leg 274 allows the height of the body board table 270 to be adjusted as shown in FIGS. 20 and 44.

Figure 5:
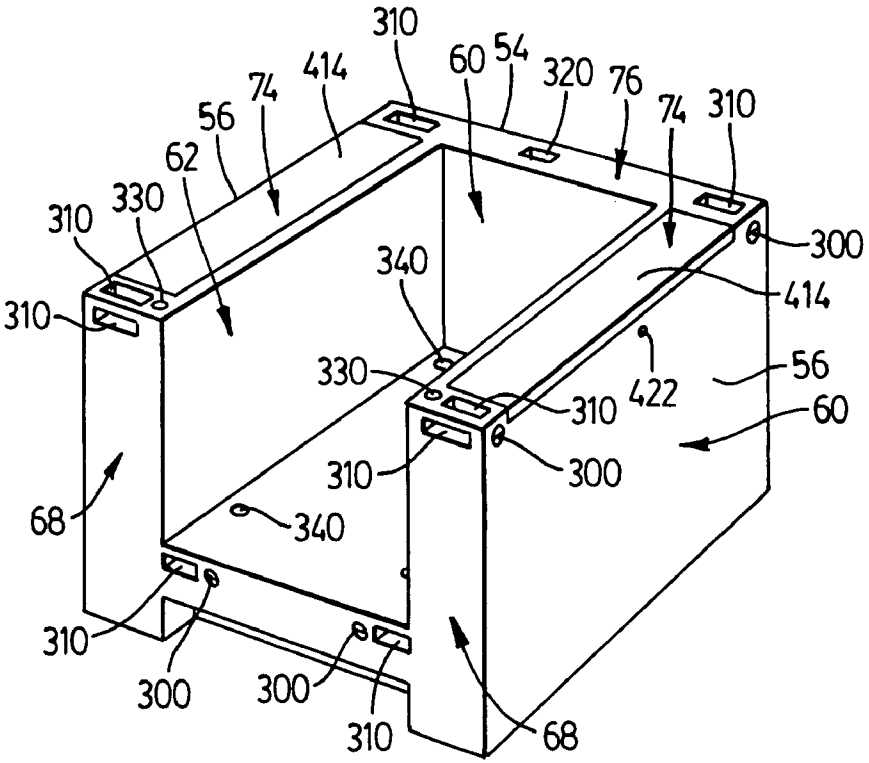
FIG. 5 is a perspective view corresponding to FIG. 4 from another angle.
Figure 4:
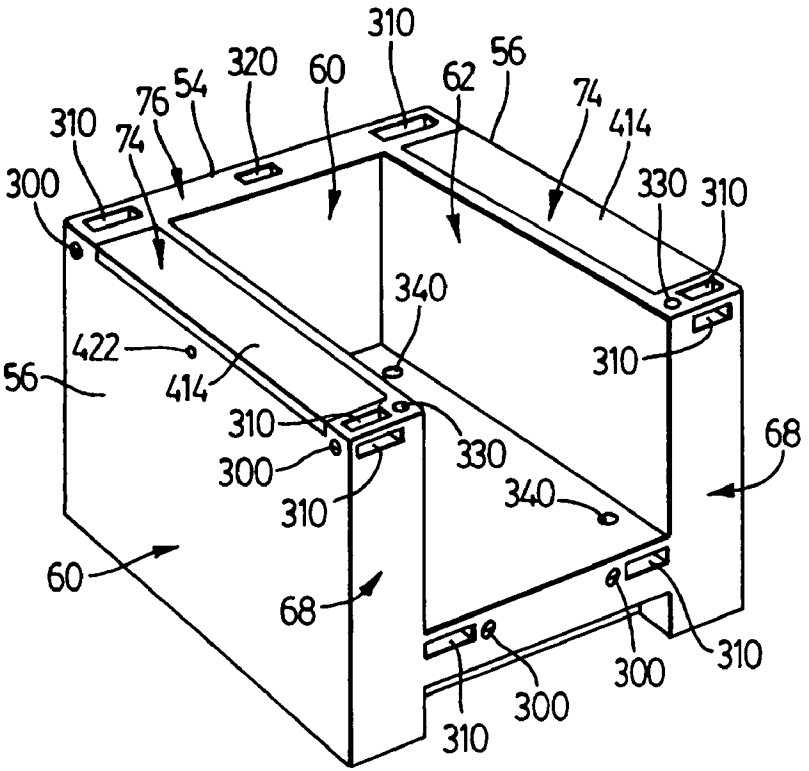
FIG. 4 is a perspective view of the chair of FIG. 1 without any concealments means or accessories.

The bottom end of the lower leg 294 can be inserted into a socket 340 located on the chair 50 as illustrated by FIGS. 4, 5 and 23. As shown in FIG. 20, when the support legs are attached to the body board 272, the body board 272 is suspended over the base 52.

The socket 340 may have a diameter slightly larger than the bottom end of the lower leg 294 and has a depth sufficient to receive the lower leg 294 such that when the body board table 270 is engaged as shown in FIGS. 38, 39, 40, 41, 42, 43, 44, 45, 46 and 47, the body board table 270 is prevented from being detached from the chair 50.

As shown in FIG. 23, the body board table 270 may have a plurality of adjustable straps 298 for securing a person.

Figure 21:
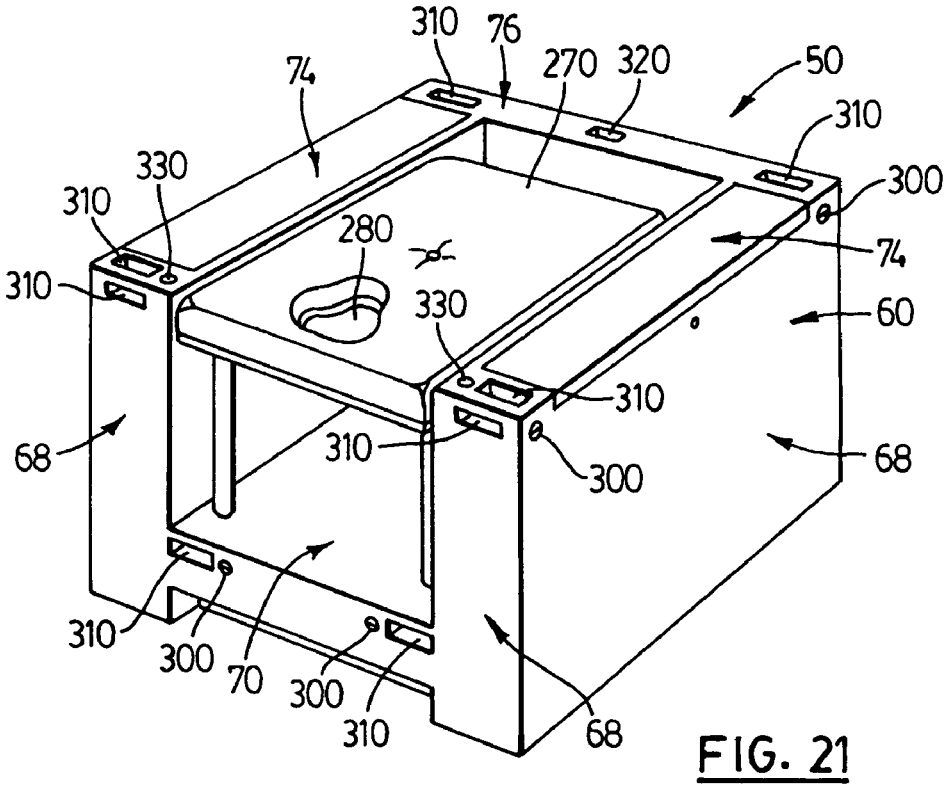
FIG. 21 is a perspective view corresponding to FIG. 20 but illustrating the body board table attached in an alternate position according to the present invention.

As shown in FIGS. 20 and 21, the body board table 270 may be attached to the chair 50 in different orientations.

As shown in FIGS. 41, 42, 43 and 46, the body board table 270 can form different configurations such as a planar configuration (FIG. 41), a declining configuration (FIG. 42), and an inclining configuration (FIG. 43).

To improve comfort for a person seated on the chair 50, a back cushion 400 may be placed on the inner chair surface 66 as illustrated in FIGS. 1, 2 and 3. The back cushion 400 may be padded and upholstered with any material suitable for furniture such as foam and leather respectively.

As shown in FIGS. 1 and 2, a seat cushion 402 may be placed on the top chair surface 70, thereby forming the top portion of the base 52 and providing a seating surface 404. The seat cushion 402 may be padded and upholstered with any material suitable for furniture such as foam and leather respectively. As shown in FIG. 1, the seat cushion 402 is shaped to fit the top chair surface 70.

As shown in FIGS. 2 and 3, when the seat cushion 402 is fitted on the top chair surface 70, a front end 406 may protrude outwardly, creating an overhang 408 to cover the bar attachment point 300 and the hook slot 310 located on the front chair surface 68.

As shown in FIGS. 2 and 3, the body board 272 may be stored between the seat cushion 402 and top chair surface 70.

As illustrated in FIG. 3, the chair 50 may have a chair cover 410 for covering the various attachment points located the arm rest top surface 74 and the top back support surface.

As shown in FIG. 24, the chair 50 may have two storage compartments 412 for storing the accessories referred to above. Each of the storage compartments 412 may be located within a respective of the arm rests 56, accessible from the arm rest top surface 74, by uncovering the storage lid 414. As shown in FIG. 24, one side of the storage lid 414 may be hingedly attached to the chair 50. As shown in FIG. 26, the storage compartment 412 may have a locking mechanism 422 to prevent access to the storage compartment 412.

As shown in FIG. 24, the chair 50 may have further storage means in the form of a drawer 416 accessible at the outer rear chair surface 64. The drawer may slidably engage with the chair 50 and may have a drawer handle 418 for providing a means to slide the drawer 416 open or close. The drawer 416 may have a generally flat front surface 420, thereby maintaining the contour of the chair 50 when the drawer 416 is closed.

Figure 25:
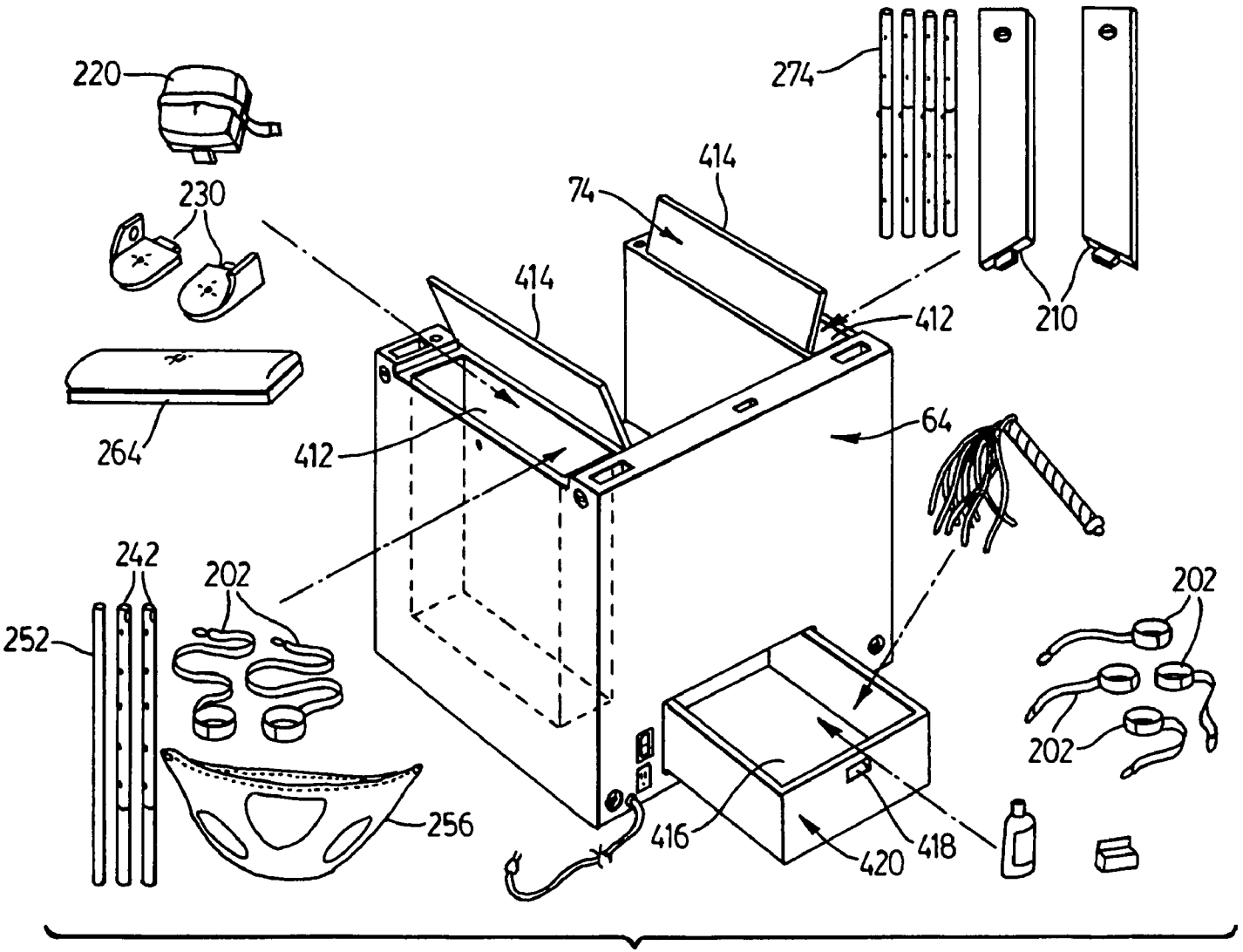
FIG. 25 is an exploded view of the chair of FIG. 24 illustrating how the accessories may be storable within the storing means according to the present invention.

As shown in FIG. 25, all the various accessories referred to above may be stored in the storing compartments 412 and the drawer 416.

As shown in FIG. 24, a vibrator 430 may be placed within the base 52, for causing the chair 50 to vibrate. The vibrator 430 is preferably electrically powered and connected to a switch 432 for activating and deactivating the vibrator 430. As shown in FIG. 24, the switch 432 is preferably located on the outer rear chair surface 64. The chair 50 may have an electrical cord 434 for providing electrical power to the vibrator 430. The vibrator 430 may be an electric motor with an eccentric weight coupled to its armature.

As shown in FIG. 24, the chair may have an electrical outlet 436 for providing power to sexual electrical devices, including low voltage shocking equipment, that may be used in association with the chair 50. The electrical outlet 436 may be connected to an electrical cord 434 as shown in FIG. 24 for providing the electrical outlet 436 with electrical power. A transformer would may also be provided.

Figure 7:
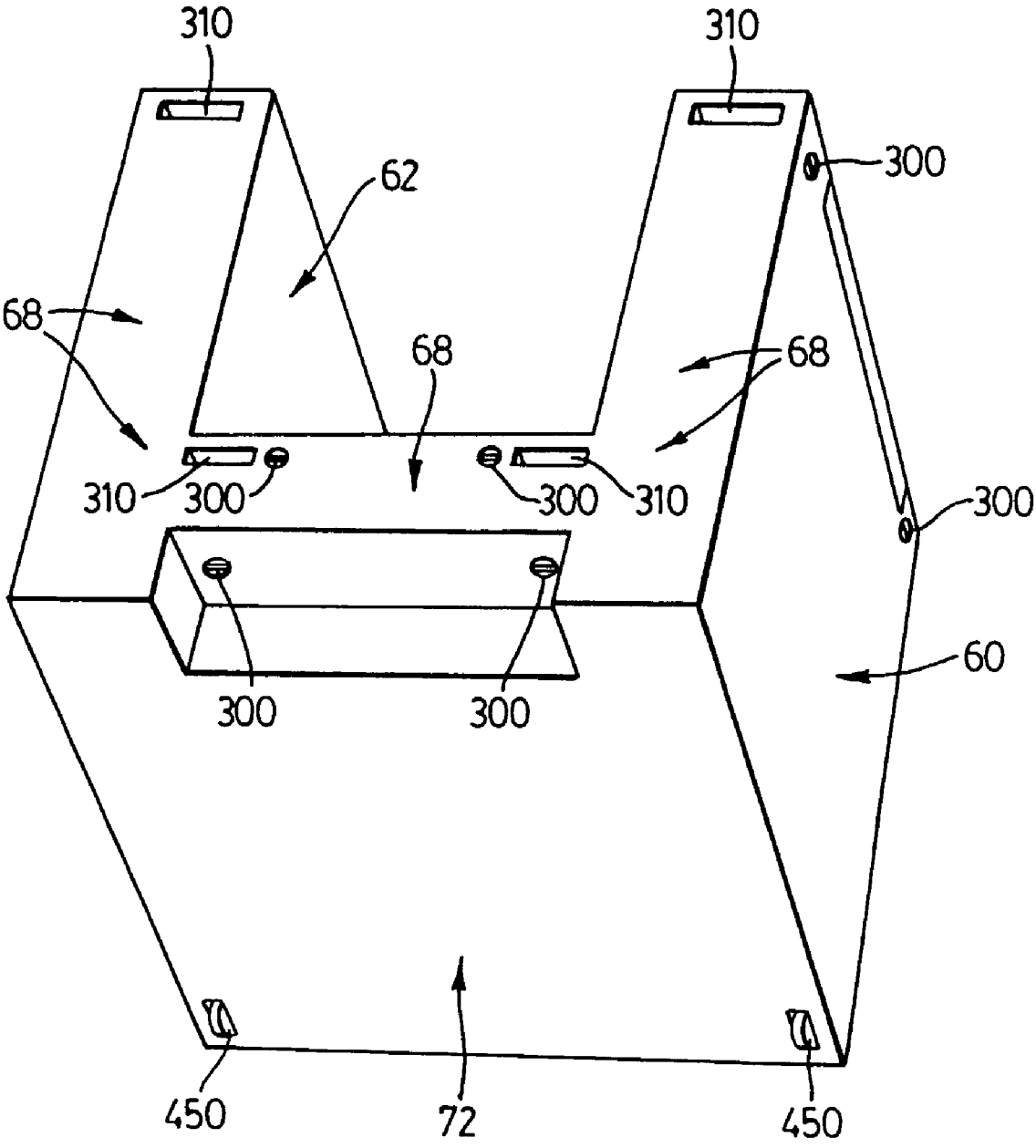
FIG. 7 is a bottom perspective view of an alternate embodiment of the chair according to the present invention illustrating rollers attached thereto.

As shown in FIG. 7, a plurality of rollers 450 may be attached to the bottom chair surface 58 for assisting a person in moving the chair 50.

FIGS. 33 to 47 are self explanatory illustrations showing different ways in which the chair 50 may be used by a person 600 and a person 602 as an adult entertainment device with the various accessories attached thereto.

The above description is intended in an illustrative rather than a restrictive sense. Variations may be apparent to those skilled in such structures without departing from the spirit and scope of the invention as defined by the claims set out below. For example, although not shown in the drawings, it is possible to conceal the attachment point 300 with a plug.

PARTS LIST

50 chair
52 base
54 back support
56 arm rests
60 outer side chair surface
62 inner side chair surface
64 outer rear chair surface
66 inner rear chair surface
68 front chair surface
70 top chair surface
72 bottom chair surface
74 top arm rest surface
76 top back support surface
202 shackle
204 strap
206 adjustable wrist/ankle band
208 fastener
210 cross-board
212 hook
220 headrest
222 projection
224 adjustable strap
230 footpad
232 flat surface
234 foot guard
236 hook
240 swing
242 tubular pole
244 top end of tubular pole
246 bottom end of tubular pole
248 hole extending through tubular pole
250 hole extending into tubular pole
252 horizontal bar
254 latch
256 swing seat
258 link
260 link that can be opened
262 aperture
264 kneeler
270 body board table
272 body board
274 support leg
278 bottom table surface
280 slot
282 socket
284 hole
286 pivotal socket
290 mounting means
292 upper leg
294 lower leg
296 spring biased extensible pin
298 adjustable straps
300 bar attachment point
302 horizontal bar
310 hook slot
312 inner part of hook slot
320 rectangular slot
330 socket receiving tubular pole
340 socket receiving support leg
400 back cushion
402 seat cushion
404 seating surface
406 front end of seating surface
408 overhang
410 chair cover
412 storage compartment
414 storage lid
416 drawer
418 drawer handle
420 flat front surface of drawer
422 locking mechanism
430 vibrator
432 switch
434 electrical cord
436 electrical outlet
450 roller

I claim:

1. A reconfigurable chair for facilitating sexual activities comprising:

(a) a base having a seating surface and a back support attached to the base for supporting a person seated on the seating surface;

(b) at least one removable accessory for supporting a person on or securing a person to the chair in a position conducive to sexual purposes, said removable accessory is at least one member selected from the group consisting of a swing, wrist restraints, ankle restraints, a body board table, stirrups, shackles, cross boards, foot pads, head restraints, strapping means and a kneeler (c) at least one connector component located on the chair for removable attachment thereto of the accessory in a deployed configuration;

(d) concealment means moveable between a concealment position for cover the at least one connector component when the accessory is unattached, and an uncovered position wherein the connector component is accessible;

the chair being reconfigurable by attachment or removal of the at least one accessory and by movement of the concealment means between the concealment and uncovered positions, between a chair having a chair-like appearance and apparatus for at least one of supporting and restraining a person in a position conducive to engaging in sexual activities;

wherein the concealment means is shaped to maintain the contour of the chair in the concealment position;

wherein the concealment means is a member selected from the group consisting of a pillow, a chair cover, a plug, a seat cushion, and a back cushion;

a plurality of rollers attached to the bottom face of the chair for assisting a person in moving the chair;

a storing means located on the chair for retrievably storing the accessories;

wherein the storing means has a closed configuration and is shaped to maintain the contour of the chair in the closed configuration;

wherein the swing comprises a first pole and a second pole, each attachable to a respective said connector component in a substantially vertical position and sufficiently spaced apart to accommodate a person positioned between the poles, at least one connector component on each said first and second pole for attaching additional said attachments;

a seat attachable to each said pole to suspend a person above the base; wherein the accessory is a body board table which is partially collapsible to be reconfigurable between a planar configuration, a reclined configuration and a declined configuration, the body board table having a slot thereon to accommodate the face of a person and a plurality of sockets for receiving a plurality of support members wherein the support members are (i) attachable to respective attachments points on the chair to suspend the body board over the base and (ii) telescopic such that the height of the body board table is adjustable.

* * * * *